United States Patent [19]

Ferguson

[11] Patent Number: 4,830,683

[45] Date of Patent: May 16, 1989

[54] APPARATUS FOR FORMING VARIABLE STRENGTH MATERIALS THROUGH RAPID DEFORMATION AND METHODS FOR USE THEREIN

[75] Inventor: Hugo S. Ferguson, Averill Park, N.Y.

[73] Assignee: MRE Corporation, Sand Lake, N.Y.

[21] Appl. No.: 171,556

[22] Filed: Mar. 22, 1988

Related U.S. Application Data

[63] Continuation-in-part of Ser. No. 31,429, Mar. 27, 1987, abandoned.

[51] Int. Cl.[4] ..... C21D 7/00; C21D 7/02; C21D 7/13

[52] U.S. Cl. ..... 148/11.5 R; 148/12 R; 72/200; 72/201

[58] Field of Search ..... 148/11.5 R, 11.5 A, 148/11.5 F, 11.5 C, 11.5 N, 12 R, 12 E, 12 B, 12 C, 12 D, 12 F, 12 BA; 266/87, 259; 72/200, 201; 29/110

[56] References Cited

U.S. PATENT DOCUMENTS

| | | | |
|---|---|---|---|
| 2,393,363 | 1/1946 | Gold et al. | 148/12 D |
| 2,814,578 | 11/1957 | White | 148/12 D |
| 3,323,953 | 6/1967 | Lesney | 148/12 D |

(List continued on next page.)

FOREIGN PATENT DOCUMENTS

| | | |
|---|---|---|
| 0196447 | 10/1986 | European Pat. Off. . |
| 2220585 | 10/1974 | France . |
| 58-144422 | 8/1983 | Japan . |
| 60-9827 | 1/1985 | Japan . |

OTHER PUBLICATIONS

Y. Lakhtin, Engineering Physical Metallurgy (© 1965: Gordon and Breach; New York), p. 161.

(List continued on next page.)

*Primary Examiner*—Wayland Stallard

*Attorney, Agent, or Firm*—Peter L. Michaelson

[57] ABSTRACT

The invention relates to apparatus and accompanying methods for use therein for forming a material (504), which has high strength and good workability, by rapidly deforming a suitable base metal (501) having a banded structure, such as illustratively a previously cold worked plain low carbon steel alloy, in order to generate a high rate of change in its internal energy which depresses the transformation temperatures of the base metal and thereby induces an allotropic phase transformation to occur therein. This rapid deformation can be produced through rolling, extrusion or forging and causes an extremely high heating rate to occur at each surface of the base metal. Prior to being deformed, the base metal is maintained at a fairly low temperature, e.g. at or near room temperature. The tooling, preferably rolls, that is used to provide the deformation is maintained at a modestly elevated temperature. Subsequent rapid deformation of the base metal causes an extremely high heating rate to occur at each surface thereof which, in turn, depresses the upper and lower on heating transformation temperatures at surface regions of the base metal and thereby causes the banded structure of the metal situated in these surface regions to transform into equiaxed grains. If the heating rate is insufficient to raise the temperature of the core of the base metal, which contains banded grains, to a level that causes metal in the core to transform, then the core will retain its banded cold worked structure. Consequently, the transformed surface regions (510, 510') will possess an equiaxed grain structure which provides increased ductility; while the core (511) of the material retains its banded (deformed) grain structure which provides high strength. Hence, the surfaces (512, 512') of the material become soft and ductile while the core possesses considerably higher amounts of hardness, yield and tensile strength than either surface. This material advantageously exhibits both good workability and relatively high strength. Alternatively, if the deformation rate is increased, such as by using small diameter rolls, in order to increase the bulk heating rate of the base metal and the appropriate thickness of the base metal has been chosen, then the entire base metal transforms into equiaxed grains. In this case, the resulting material (404) possesses a ductility and hence workability similar to that of a fully annealed structure.

39 Claims, 12 Drawing Sheets

U.S. PATENT DOCUMENTS

| | | | |
|---|---|---|---|
| 3,855,013 | 12/1974 | Prohaszka et al. | 148/12 R |
| 3,877,281 | 4/1975 | Shimizu et al. | 72/364 |
| 3,929,517 | 12/1975 | Nakamura et al. | 148/12 F |
| 4,046,598 | 9/1977 | Janzon | 148/12 R |
| 4,060,428 | 11/1977 | Wilson et al. | 148/12 R |
| 4,086,105 | 4/1978 | Mayrhofer et al. | 148/12 R |
| 4,108,695 | 8/1978 | Paulitsch et al. | 148/39 |
| 4,146,411 | 3/1979 | Dewsnap et al. | 148/12 B |
| 4,204,884 | 5/1980 | Berg et al. | 148/12 R |
| 4,375,375 | 3/1983 | Giamei et al. | 148/11.5 F |
| 4,395,296 | 7/1983 | Abrams | 148/12.4 |
| 4,410,372 | 10/1983 | Takahashi et al. | 148/12 D |
| 4,426,235 | 1/1984 | Sudo et al. | 148/12 C |
| 4,466,842 | 8/1984 | Yada et al. | 148/12 R |

OTHER PUBLICATIONS

E. J. Teichert, Metallography and Heat-Treatment of Steel (Ferrous Metallurgy—vol. III), © 1944, McGraw-Hill Book Company, Inc., New York, p. 137.

The desk edition of The Metals Handbook (© 1985, American Society of Metals; Metals Park, Ohio), p. 28.2.

C. Keyser, Basic Engineering Metallurgy—Theories, Principles and Applications (© 1959: Prentice-Hall, Inc.; Englewood, New Jersey, p. 189.

L. Guillet et al., An Introduction to the Study of Metallography and Macrography (© 1922: McGraw-Hill Book Company, Inc.; New York) pp. 80-81.

H. J. McQueen, "The Experimental Roots of Thermomechanical Treatments for Aluminum Alloys", Journal of Metals, vol. 32, No. 2, Feb. 1980, pp. 17-25.

R. S. Cremisio, "The New Technology of Rapid Heating and Strain Rate Studies", 1965 Transactions of the Vacuum Metallurgy Conference.

J. Dominik, "The Peculiarities of Phase Transformations in Bearing Steels at High Heating Rates", Kovove Mater., vol. 22, No. 2, 1984, pp. 155-163.

W. Reinhard, "The $\alpha$-$\gamma$ Phase Conversion of Iron at High Heating Rates", Freib. Forschungsch. B. Metall. Werkstofftech., (B244), 1985, pp. 60-74.

APPARATUS FOR FORMING VARIABLE STRENGTH MATERIALS THROUGH RAPID DEFORMATION AND METHODS FOR USE THEREIN

CROSS REFERENCE TO RELATED PATENT APPLICATIONS

This application is a continuation-in-part of my co-pending U.S. patent application entitled "APPARATUS FOR FORMING VARIABLE STRENGTH MATERIALS THROUGH RAPID DEFORMATION AND METHODS FOR USE THEREIN", which has been filed on Mar. 27, 1987 and has been assigned Ser. No. 07/031,429, now abandoned.

Materials, produced using the inventive apparatus and methods described and claimed herein, are described and claimed in my co-pending U.S. continuation-in-part patent application entitled "VARIABLE STRENGTH MATERIALS FORMED THROUGH RAPID DEFORMATION", which has been filed simultaneously herewith and has been assigned Ser. No. 07/171642, 3/22/88.

BACKGROUND OF THE INVENTION

1. Field of the Invention

The invention relates to apparatus and accompanying methods for use therein for forming a material, which has high strength and good workability, by rapidly deforming a suitable base metal, such as illustratively a low carbon steel alloy, in order to generate a high rate of change in its internal energy which depresses the transformation temperatures of the base metal and thereby induces an allotropic phase transformation to occur therein.

2. Description of the Prior Art

Materials that undergo allotropic transformations are extremely important commercially and have been for many centuries. One class of these materials and probably one of the oldest known to man and the most widely used of all is steel. Not only does steel impart strength and rigidity to a product, but steel can also be formed into any one of a myriad of different shapes. For that reason, steel finds use in a wide array of different applications and particularly as an essential component of many products.

The chemical composition of a piece of steel, along with its thermal and mechanical history, determines its mechanical properties. Basic iron, i.e. iron without any impurities, is quite soft. As a result, various elements, such as carbon, are often dissolved into iron to change its physical characteristics. Specifically, steel is made by first forming molten iron from iron ore, limestone and coke that has been heated in a blast furnace. This molten iron (steel) often contains excessively high levels of silicon, manganese, carbon and other elements which adversely affect the physical properties of the resulting alloy. Consequently, the molten iron is placed into a basic oxygen furnace or an open hearth furnace to refine the molten iron with oxygen in an effort to reduce levels of the impurities to acceptably low values. Thereafter, the molten iron is then tapped or poured into refractory-lined ladles during which time other alloying elements and various deoxidizing materials are added to the steel to fix its final chemical composition.

Now, at this point, the steel is cast into ingots or slabs, either using molds or continuous casting processes. With the chemical composition fixed, the characteristics of the resulting steel can be varied by subsequent thermal and mechanical processing.

One of the most important properties of steel alloys is their ability to undergo allotropic transformations, the ability of steel to change from a body centered cubic (bcc) crystalline structure to a face centered cubic (fcc) and back to bcc structure. Such transformations occur, without changes in chemical composition, because in certain temperature ranges one particular arrangement of atoms (e.g. bcc) that comprise a crystalline lattice is more stable (i.e. has a lower free energy state) than another arrangement. Inasmuch as the structure of the steel will always assume that arrangement which under equilibrium conditions yields the lowest free energy for a given thermal treatment, such transformations frequently occur with changes in temperature.

Different crystalline arrangements produce different mechanical properties. As such, controlling the allotropic transformations during the manufacture of steel greatly dictates the physical properties of the resulting steel. A large number of methods and processes exist to provide this control; however, the most common process is heat treatment using conventional furnaces, typically gas fired or electric, and suitable means of cooling, such as water or oil quenching or water, oil or gas spray. Generally speaking, a piece of steel is heated to a temperature above the transformation temperature. For eutectoid steels, the transformation temperature is a single value.

For low carbon steels, transformations occur throughout a range of temperatures, depending upon the heating rate and elapsed heating time. With an extremely slow heating rate and a long elapsed time value, the temperature at which the transformation begins is called the "Ae1" temperature and the temperature at which the transformation (from bcc to fcc) is complete is called the "Ae3" temperature. The "e" denotes equilibrium values. During heating or cooling, the Ae1 and Ae3 temperature values shift thereby producing a band of values: a continuous heating transformation (CHT) curve for heating and a continuous on-cooling curve (CCT) for cooling. For heating or cooling, these values are denoted by the corresponding letter "c"—for the French word "chauffage" for heating or "r"—for the French word "refroidissement" for cooling. Once the steel has reached the Ac3 temperature it has been completely transformed into a high temperature product, which is typically austenite (a solid solution of carbon in fcc iron). Thereafter, once the steel is cooled below the Arl temperature, it has transformed back to a low temperature product, typically a bcc structure. The particular low temperature product that results is governed by the particular cooling procedures used. For example, ferrite (a solid solution of carbon in bcc iron) and pearlite (alternate lamellae of ferrite and iron carbide, the latter often referred to as cementite), which often exist together as a low temperature product, is generally formed by slowly cooling austenite using either furnace cooling or air cooling. Martensite, which is another low temperature product, occurs when austenite is rapidly cooled on an uninterrupted basis typically using oil or water quenching. If austenite is cooled at a rate between that for martensite or pearlite, then bainite may form. Bainite is another low temperature product and is a mixture of ferrite and cementite. Each low temperature product has different mechanical properties. A pure martensitic structure is the hardest and most brittle microstructure that can be produced in steel, while a pure ferritic structure is the softest. Pearlitic structures are considerably softer and more ductile than a fully martensitic structure but slightly less so than a pure ferritic structure. Consequently, heating and cooling procedures, coupled with prior mechanical working of the steel, influence the microstructure of the steel and its resulting physical properties. When low carbon steels are heated just above the Ac3 temperature and then cooled to room temperature, a fine grain structure results. This is a basic grain refinement procedure and may be performed several times to produce very fine grain structures. For a given hardness, the finer grained materials have higher strengths.

For many years, the art has taught that upon heating the Ac1 and Ac3 temperatures for low carbon steels generally increase from their equilibrium values with increasing heating rates. Specifically, see, for example, Y. Lakhtin, *Engineering Physical Metallurgy* (c. 1965: Gordon and Breach, New York) which states on page 161:

> "Upon continuous heating at various rates . . . pearlite is transformed into austenite . . . , not at a constant temperature but in a certain temperature interval . . . . *The higher the heating rate, the higher will be the temperature of the transformation.*" [emphasis added].

Similar teachings appear in E. J. Teichert, *Metallography and Heat-Treatment of Steel* (*Ferrous Metallurgy—Volume III*) (c. 1944: McGraw-Hill Book Company, Inc.; New York) which states on page 137:

> "*The constitutional [phase] diagram shows the position of the critical points under conditions of extremely slow heating or cooling and does not indicate their position when any other rate is employed. It is found that, when rates different from those specified under the conditions of the diagram are employed, the critical points do not occur at the same temperature on heating or cooling. This lag in the attainment of equilibrium conditions is termed hysteresis, which implies a resistance of certain bodies to undergo a certain transformation when this transformation is due. Therefore, the Ac point occurs at a temperature somewhat higher than would be expected. Similarly, the Ar point is somewhat lower. This difference between the heating and cooling criticals varies with the rate of heating or cooling. In other words, the faster the heating the higher will be the Ac point, and the faster the heating the higher will be the Ac point, and the faster the cooling the lower will be the Ar point.*" [emphasis added].

In additional, similar teachings also appear on page 28.2 of the desk edition of *The Metals Handbook* (c. 1985, American Society of Metals; Metals Park, Ohio), on page 189 of C. Keyser, *Basic Engineering Metallurgy—Theories, Principles and Applications* (c. 1959: Prentice-Hall, Inc.; Englewood Cliffs, N.J.) and on pages 80–81 of L. Guillet et al, *An Introduction to the Study of Metallography and Macrography* (c. 1922: McGraw-Hill Book Company, Inc.; New York). Therefore, these teachings indicate that increasingly higher temperatures must be used to obtain transformations in increasingly shorter periods of time. This characteristic is typically found in diffusion controlled processes.

Now, having realized the importance transformations play in steel, it is now useful to discss the typical manner in which a useable steel product, such as strip, is fabricated from ingot or slab (collectively referred to as ingots) and where transformations enter into the fabrication process.

Ingots are successively rolled to obtain thin strip stock. Each pass through a rolling mill reduces the thickness of the ingot and expands its length. To obtain large reductions in thickness, the ingot is first reduced in a roughing mill and then hot rolled through a hot strip mill. Hot rolling is performed at temperatures above the Ac1 and generally above the Ac3 temperatures. At typical hot rolling temperatures of between 850–1100 degrees Celsius (C), steel has a relatively low flow stress and requires considerably less mechanical energy than in cold rolling to obtain a large reduction in thickness. In fact, very large reductions in thickness, on the order of an inch or more, are only possible during each pass through a roughing mill stand. At these temperatures, the steel exists as pure austenite. Hot rolled products generally exist in thicknesses of 0.06 inch (0.15 centimeters) or greater. The strength of hot rolled steel is somewhat higher than that of an annealed cold rolled steel; however, the formability of hot rolled steel is somewhat lower than that of an annealed cold rolled steel. Once hot rolling is complete, the steel strip is cooled at a controlled rate, typically using a water spray, to transform the austenite into a ductile low temperature product, such as ferrite and pearlite, prior to cold rolling and thereby prevent the steel from fracturing.

In general metallurgical practice, recrystallization is considered to be the result of heat treating steels below the Ac1 temperature. Any heat treatment above the Ac1 temperature may result in partially or fully transformed structures.

Where thicknesses less than 0.06 inches (approximately 0.015 centimeters), better surface finishes and/or improved formability over that produced by a hot strip mill is required, the strip stock is further processed by cold rolling. Here, cold rolling generically refers to the process of passing unheated metal through rolls for the purpose of reducing its thickness. Cold rolling provides a product having a better surface finish and more precisely controlled dimensions than that which is possible through a hot mill. A typical five stand cold rolling mill may reduce the thickness of incoming strip by 75–90% with each stand generally being responsible for no more than a 40% reduction in thickness. During the rolling process, the temperature of the rolls rises due to plastic deformation of the material in the strip situated in the roll gap and frictional energy generated at each roll/-strip contact. Because some of this energy remains in the strip, the temperature of the strip rises. In particular, strip is frequently at room temperature when it enters a cold rolling mill. After each rolling operation, the temperature of the strip as it exits from each stand is considerably higher than room temperature. For example, the temperature of the strip may reach 180 degrees C. as the strip exits the fourth stand in a five stand cold rolling mill. Inasmuch as the last stand (e.g. fifth stand in a five stand mill) is used to provide surface and leveling control of the strip, this stand imparts only a small reduction to the strip, typically ranging from a few percent to as much as 20% of the entering thickness. As such, the temperature of the strip as it exits from the fifth stand is often lower than that associated with the fourth stand but nonetheless considerably higher than room temperature. Throughout the cold rolling mill, the temperature of the strip is maintained, through use of suitable cooling sprays directed at both the strip and the rolls, well below temperatures at which the material in the strip would either transform or recrystallize.

As noted, cold rolling occurs below the recrystallization temperature, which is the temperature at which stressed, plastically deformed grains begin to recrystallize into new stress-free grains. Hence, equiaxed grains present in cooled hot rolled products are mechanically deformed into elongated (or banded) grains by cold rolling and remain in that state until subsequent heat treatment occurs. This deformation causes several effects, some of which are adverse.

First, cold rolling substantially distorts the crystalline structure of the steel strip and consequently substantially increases the density of dislocations present therein. This, in turn, increases the internal stresses occurring within the steel strip. Hence, the yield strength of a plain low carbon steel strip rises significantly, to on the average approximately 95,000 psi, while the ductility of the strip decreases significantly. Inasmuch as the amount of deformation a material will withstand before fracturing depends upon its ductility, a severely cold worked material may only accept a small amount of deformation before it fractures. However, to additionally deform the steel by further cold working, the ductility of the steel strip must be sufficiently high to prevent fracturing. Therefore, to obtain further large reductions in thickness by cold rolling, the steel strip may have to undergo one or more heat treatments to restore its ductility prior to subsequent cold rolling or fabrication. Such treatments reduce hardness and strength of the strip but advantageously increase its ductility. Moreover, the final strip produced by a cold mill is generally excessively hard and brittle for most applications. To restore its ductility this final strip stock is annealed, i.e. heated in an annealing furnace into the austenitizing temperature range and then slowly cooled from this range to room temperature. This causes the elongated stressed ferrite and pearlite grains to first transform to austenite and then during slow cooling transform back into equiaxed stress-free ferrite and pearlite grains thereby relieving the internal stress within the strip. Alternatively, the strip could be heated to a temperature just below the Ac1 temperature, then held for an appropriate amount of time in order to allow the strip to recrystallize into stress-free grains and finally slow cooled. The resulting strip, having a yield strength on the order of approximately 30,000 to 50,000 psi depending upon the carbon content, is now capable of undergoing further significant cold reductions without fracturing. Annealing is typically done in a batch process using a slow heat-up, long soak and slow cooling cycle to ensure maximum formability. Annealing temperatures typically range between 730–950 degrees C. The entire batch annealing process may consume five to six days. To ensure that the annealing process does not cause a bottleneck to the entire steel mill, a number of separate annealing furnaces are operated at once but in staggered stages of annealing. Some furnaces are typically being loaded, while others are heating, others are cooling and the remainder are being unloaded. Unfortunately, such a staggered annealing process requires large amounts of capital to install and operate and consumes substantial amounts of space. Alternatively, continuous annealing lines, as discussed below, may be employed to reduce the total annealing time to less than one hour. Once the strip has been annealed, it may need to undergo a "skin" pass through a temper mill which imparts the desired flatness, metallurgical properties and surface finish to the strip stock. A skin pass typically involves imparting a very small amount of deformation, typically less than a few percent, to the finished strip and produces proportionate elongation of the strip.

Second, cold worked steel is directional. The elongated non-equiaxed grains produced by cold working impart different mechanical and electrical properties to the strip in directions parallel to and transverse to the direction in which the strip was rolled. For example, a cold worked unannealed strip is substantially more formable along a direction transverse to the rolling direction, i.e. perpendicular to the major axis of the grains, than along a direction parallel to the rolling diection. Both recrystallization and heat treatment through the transformation region eliminate all or some of the directional properties. For complete recrystallization to occur and thereby remove all effects of directionality, an annealing type heat treatment must be used to allow the steel to recrystallize into an equiaxed grain structure. Alternatively, the material may be completely transformed to austenite and then slow cooled to room temperature to produce a completely transformed structure, i.e. a completely annealed equiaxed structure.

As noted above, continuous strip annealing lines have been developed which anneal the strip in less than one hour. In such a line, the steel strip is passed at mill speed through separate heating and cooling zones, where the strip is heated, held at temperature and cooled or quenched. This process may be done at different rates which may change during any part of the process. Moreover, such a line is often designed to heat treat the strip several times as it passes through the line. In order to quickly elevate the temperature of the material into the austenite region, very high temperatures are used. Although this produces an end product of uniform structure, it does so at considerable cost. Specifically, strip annealing mills are expensive, typically over $200 Million, to acquire and install. Second, high temperature heat treatments cause an oxide layer ("scale") to build up on each surface of the strip. The amount of oxide increases with time at temperature. Therefore, additional machinery is needed to remove this scale from each surface. Although most continuous annealing lines include surface cleaning equipment, this equipment adds to the cost of the line. Alternatively, the scale can be eliminated by shrouding the steel, as it travels through the continuous annealing line, with an inert or reducing atmosphere. However, the cost of the equipment needed to do so adds expense to the continuous annealing line, both in terms of initial cost and subsequently incurred operating costs.

Therefore, in view of this manufacturing process, cold rolled low carbon steel alloys present a tradeoff: non-annealed cold rolled products possess relatively high values of yield strength and hardness and a correspondingly low degree of formability, while annealed products provide a high degree of formability and relatively low values of yield strength and hardness—typically less than half that of the non-annealed cold rolled products. Although, low carbon steel alloys comprise the least expensive of all commercially available steel alloys and, for that reason, are widely utilized, a single piece of a low carbon steel alloy does not provide both high strength and high formability. As a result, a user decides which of these two characteristics, high strength or formability, is more important in any given application and chooses a material accordingly. However, in those applications, where a formability-strength tradeoff can not be tolerated, i.e. where a steel must possess both high strength and good formability, a high strength low alloy (HSLA) steel or other types of steels are frequently used instead of low carbon steel. Unfortunately, such steels are more difficult to produce and hence considerably more expensive than low carbon steels. In addition, these steels are often harder to weld and form than low carbon steels.

Furthermore, the production of "black plate" as it is used in the making of tin plate provides another example where present processes taught in the art are inadequate to provide suitable material for an end use. In particular, U.S. Pat. No. 2,393,363 (issued to J. D. Gold et al on Jan. 22, 1946—hereinafter referred to as the '363 Gold et al patent) and U.S. Pat. No. 3,323,953 (issued June 6, 1967 to A. Lesney—hereinafter referred to as the '953 Lesney patent) disclose methods which are aimed at obtaining a material, such as a strip, having a strong core and a soft surface. The '363 Gold et al patent discloses use of conventional heat treatments to obtain recrystallization of the surface but no recrystallization of the core. Specifically, a suitable material is surface heated to a relatively high value, here 1500 degrees F. (approximately 816 degrees C.), sufficient to cause recrystallization of the surface. Once the material has recrystallized to a desired depth, heating is stopped and the material is then appropriately cooled to remove any excess heat and, by doing so, inhibit any further recrystallization. The '953 Lesney patent discloses the use of a special material where the surface region contains material that is more susceptible to recrystallization than the material situated in the core. Specifically, the special material, here rimmed steel with a maximum manganese content of less than 0.15%, is annealed in strip form at a relatively high temperature, here 800–1150 degrees F. (approximately 427–621 degrees C.), for a time sufficient to substantially recrystallize the surfaces of the strip, but insufficient to recrystallize the core of the strip.

Prior art processes based upon surface recrystallization, such as those disclosed in the '363 Gold et al and '953 Lesney patents, possess several drawbacks which significantly limit their commercial use. First, these processes depend upon imparting a controlled amount of heat at a desired depth in a material being processed. The amount of heat that a material absorbs varies with many factors, such as for example conduction by surrounding air and reflectivity of the surface of the material. Unfortunately, these factors may vary for different materials and even for different pieces of the same material thereby complicating the control of the heating process. Moreover, since recrystallization is a diffusion controlled process, it is time dependent. Frequently, a fairly long interval of time typically lasting several seconds, if not minutes, is required for a material or even a portion of it to recrystallize. As such, heating a material to impart a controlled amount of heat to a certain desired depth from its surface throughout a particular period of time is extremely difficult to accurately accomplish on a repetitive basis with different pieces of the same or different material.

Consequently, a need exists in the art for new materials, formed from illustratively inexpensive low carbon steel alloys, that provide both higher strength and higher formability than various materials currently available. An additional need exists for apparatus and accompanying methods that can be used to easily and inexpensively produce such materials. Such a method should not rely on recrystallization.

SUMMARY OF THE INVENTION

Accordingly, an object of the present invention is to provide apparatus and accompanying methods for use therein which can be used to easily and inexpensively produce a material that undergoes allotropic transformations and which offers higher strength and higher formability than various materials currently obtainable in the art.

Another object is to provide apparatus and accompanying methods for use therein that can be used to produce such a high strength material that is not likely to experience surface cracking or fracturing when deformed.

A specific object is to provide such methods for use in this apparatus that can produce such a material that has surfaces, each with a high degree of formability and low strength, surrounding a core having relatively high strength and low formability.

A further object is to provide methods of producing such materials which reduces the initial plant costs and subsequently incurred operational costs associated with producing cold rolled products that have high strength and good workability.

Another object is to provide such methods which eliminate the need to heat the material above the Ae1 temperature in order to cause it to transform into an equiaxed structure and thereby substantially reduce the amount of surface scaling imparted to the material during its manufacture.

A specific object is to provide such a method which eliminates or reduces the need to anneal the material during its manufacture and thereby reduces the cost to produce the material.

Another specific object is to provide such a method which eliminates the need for surface cleaning equipment that is expensive to install and operate.

Another object is to provide methods for use in this apparatus that produces such a material that has minimal, if any, directional properties.

These and other objects are achieved in accordance with the teachings of the present invention by rapidly deforming a base metal that undergoes an allotropic transformation, illustratively a previously cold worked low carbon steel alloy that has a deformed (banded) structure, using an energy level and rate suitable to depress its continuous heating transformation temperatures. Specifically, the applicant has discovered that, contrary to widely accepted knowledge in the art, the continuous heating upper and lower allotropic transformation temperatures, Ac1 and Ac3, decrease substantially as the rate at which the base metal is heated increases above 1,000 degrees C./second. In fact, this decrease is particularly noticeable for heating rates exceeding 10,000 degrees C./second. This indicates that, as long as the base metal is heated at a high rate, it will transform from a banded structure to an equiaxed structure at much lower temperatures than had been expected from existing knowledge in the art. In accordance with the principles of applicant's invention, as discussed below, these heating rates can easily be produced by rapidly deforming the base metal structure in a suitable fashion.

The resulting material produced in this manner, illustratively a low carbon steel alloy, has equiaxed grains near the surface and banded grains in the interior (core).

The banded grains in the core provide an increased yield strength over the same alloy having equiaxed grains throughout its cross-section. The equiaxed grains appearing along the surfaces impart ductility to these surfaces and hence to the material.

Generally speaking, during the production of materials that undergo allotropic transformations, such as steel, these materials are deformed beyond their elastic limit into an appropriate shape generally by expending mechanical energy to force the material through appropriate tooling, e.g. rolls or dies, using rolling, forging or extruding processes. Some of the mechanical energy applied to the material is utilized in actually deforming the material, i.e. overcoming the inherent binding energy of a crystalline structure and increasing its dislocation density. Another portion of the energy is used to overcome the friction between the material being deformed and the tooling. A large amount of this energy is converted to heat. When the tooling is located against the surface of the material, as in rolling or extruding processes, the heat expended in sliding friction is partly transferred to the tooling and the remainder transferred to the material. The art teaches that this heat must be removed, often by flood lubrication in which a water-soluble oil, a mixture of oils in water or even plain water is directed against the rolls and the surface of the material, in order to prevent the temperature of the rolls and the temperature of the material from rising appreciably to the point at which the material will stick to the rolls and/or oxidize.

Now, in accordance with the teachings of applicant's invention, the temperature of the metal is forced to rise rapidly as the metal is being deformed.

In particular, if cold rolling is being used, then, contrary to accepted practice in the art, the temperature of the rolls is allowed to be considerably warmer than the entering strip and little or no effort is expended to cool the rolls. Only enough lubricant is applied to the rolls to prevent the material being rolled from sticking to the rolls but not enough lubricant is used to cause any appreciable cooling of either the rolls or the material. As a result, the temperature of the entering material rises as the strip passes through the rolls. The mill parameters—roll speed, roll size, amount of lubricant applied to the rolls, roll temperature and temperature of the entering strip—are all appropriately adjusted, in a manner appropriate to the particular mill being used, to rapidly deform the material and thereby impart a very high heating rate to the material which, in turn, depresses its upper and lower transformation temperatures.

The mechanical energy applied to the rolls (or other tooling such as dies) is dissipated in deformation of the material and in sliding resistance of the surface contact between the surface of the material and the rolls. In the rolling process, there is always one point or line of contact between the rolls and the strip where there is no sliding between the surfaces of the rolls and the strip. This point or line is called the neutral point of neutral line of contact. Since a strip is being reduced in cross-sectional area, the material entering a roll stand is moving at a slower velocity than the material leaving the stand. Hence, the material in contact with the roll in front of the neutral point is moving at a slower velocity than that of the roll surface, while the material on the exit side of the neutral point is moving at a faster velocity than that of the roll surface. This, coupled with the high pressures exerted by the rolls on the strip, generates a substantial amount of sliding friction. The energy dissipated in the sliding friction for the material, which is in contact with the rolls, before and after the neutral point frequently equals the energy dissipated in deformation. As noted, the energy dissipated in deformation and sliding friction is converted into heat with the exception of a certain amount of this energy which is stored within in the structure as additional elastic energy resulting from this deformation. With the proper roll size, roll speed and material thickness, energy will be imparted to the strip at a sufficiently rapid rate, throughout the entire cross-section of the material, to cause the temperature of the material across its entire cross-section to increase above the depressed Ac3 transformation temperature. The Ac3 temperature becomes depressed due to the very high heating rate of the strip. This, in turn, will completely transform the strip. Consequently, soft, low strength equiaxed grains will fill the entire cross-section of the material. Due to the short time during which the transformation occurs, these grains may not become as well rounded as those produced by annealing, they will nevertheless possess the values of yield strength and ductility associated with annealing.

Now, in accordance with a feature of the present invention, the yield strength and ductility of the material can be set within certain ranges by regulating the depth to which the material is transformed. This will provide a strip of good working properties, while maintaining some of the advantages of a cold worked structure. In particular, the surface material, having transformed into equiaxed grains, becomes quite ductile as is the case with an annealed structure, while the core which has not transformed retains a high yield strength associated with cold rolled structure.

The ranges for yield strength and ductility extend between the corresponding values for a strip containing completely equiaxed grains and a strip containing fully banded grains. The transformation depth can be set to any point running from the surface, in which case little or no transformation occurs, to the mid-plane of the material, in which case the entire material will be transformed into an equiaxed grain structure. Inasmuch as the non-transformed core has a higher yield strength and lower ductility—those associated with cold worked structure—than the transformed surface, the depth to which the material has been transformed will dictate the resulting yield strength and ductility of the resulting material.

Specifically, inasmuch as the thermal conductivity of the rolls and the strip is relatively low, the friction heating will be concentrated at the surface of both. As such, the surface heating of the strip, resulting from sliding friction, will be higher than the bulk heating of the strip and will add to the bulk heating produced through deformation. Consequently, the material situated at each surface of the strip will reach a higher temperature, such as the depressed Ac3 temperature, before the interior portions (core) of the strip does and hence will transform sooner than the core. As a result, the material can be mechanically worked without the surface fracturing that would otherwise occur in cold rolled strip. Since the core of the material has not transformed and remains heavily deformed, the strength of the core equals that of a cold rolled material. Hence, the resulting strip has both high strength and high formability.

Now, the depth reached by the transformation can be regulated by controlling the rate and amount of energy that is imparted to the strip. This control is based on the distance through which the strip contacts each roll, the roll speed and the amount of strain induced in the strip. The control is also dependent upon the amount of prior cold work strain present in the material. Therefore, by appropriately choosing the values of the roll diameter, the amount of prior cold work strain, the amount of induced strain, material thickness and the roll speed, the depth reached by the transformation can be pre-defined and hence the yield strength and ductility of the strip can be set.

In accordance with another feature of the invention, a strip containing partially transformed (partially refined) material can result. In this case, the rate of deformation, temperature rise of the material and amount of deformation can be adjusted such that the temperature of some of the material rises above the depressed Ac1 (lower transformation) temperature but not above the depressed Ac3 (upper transformation) temperature. In this case, for a plain low carbon steel, the material existing between each surface and a preselected depth will enter a two phase region in which it partially transforms into an equiaxed structure. However, none of the material existing below that depth and running inward to the mid-plane of the strip will transform. The surface of this material has intermediate values of yield strength and ductility (between those for equiaxed and banded structures) while the core retains a relatively high yield strength characteristic of a cold rolled structure. Hence, such a material will likely be softer than cold worked material but not as soft as a completely equiaxed structure.

BRIEF DESCRIPTION OF THE DRAWINGS

The teachings of the present invention may be readily understood by considering the following detailed description in conjunction with the accompanying drawings, in which.

To facilitate understanding, the same reference numerals have been used to designate identical elements that are common to the figures.

DETAILED DESCRIPTION

The teachings of the present invention are applicable to all materials that exhibit suitable solid state allotropic transformations which depress upon rapid heating. These materials illustratively include titanium, tin, iron alloys (steels), manganese alloys, various copper alloys, various aluminum alloys and various nickel alloys. Inasmuch as low carbon steel alloys form an extremely important class of these materials, for the sake of clarity and brevity, the remainder of this description will discuss the invention in the context of these alloys. After reading the following description, those skilled in the art will easily realize how to employ the teachings of the invention in connection with other steel alloys and other materials that undergo suitable allotropic transformations.

Now, as noted, the art has taught for many years that upon heating the Ac1 and Ac3 transformation temperatures for low carbon steels generally increase from their lower and upper equilibrium values, Ae1 and Ae3, with increasing heating rates. Therefore, this indicates that increasingly higher temperatures must be used to obtain transformations in increasingly shorter periods of time. Such an increase is evident in the diagram shown in FIG. 1 which depicts the continuous heating transformation (CHT) diagram, as it is known in the art, for a typical low carbon-plain carbon steel alloy, here type 1018 steel. This increase in the transformation temperature which results from an increase in the heating rate is typical of diffusion controlled processes.

Figure 1:
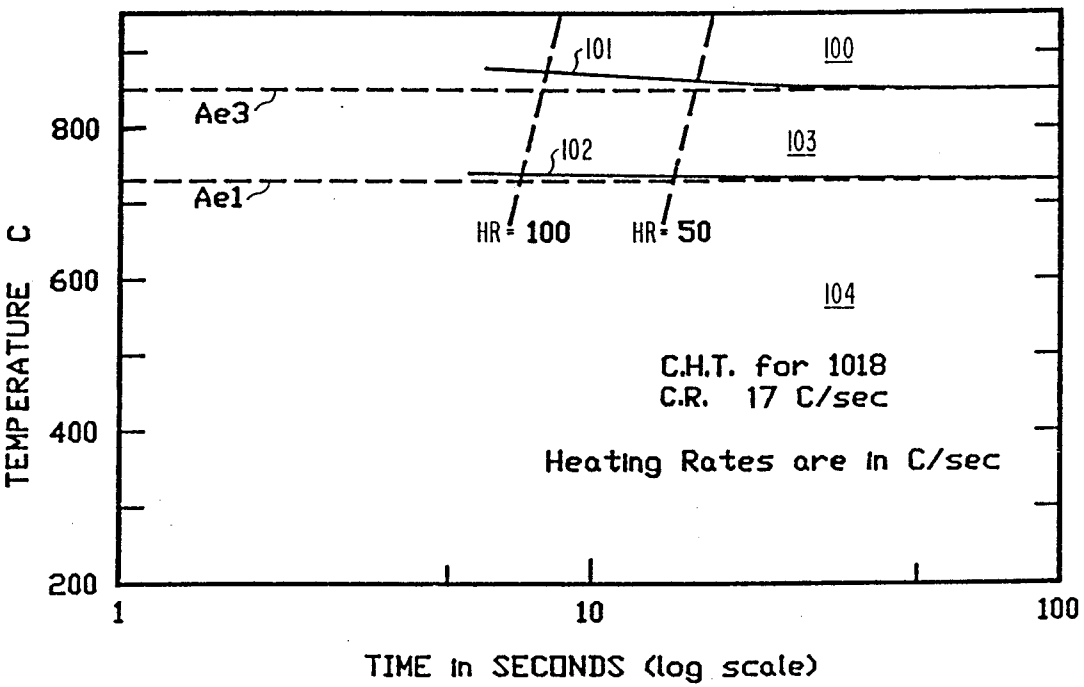
FIG. 1 (PRIOR ART)
FIG. 1 is a diagram of the continuous heating transformation (CHT), as it is known in the art, for a typical low carbon-plain carbon steel, illustratively type 1018 steel.
Figure 2:
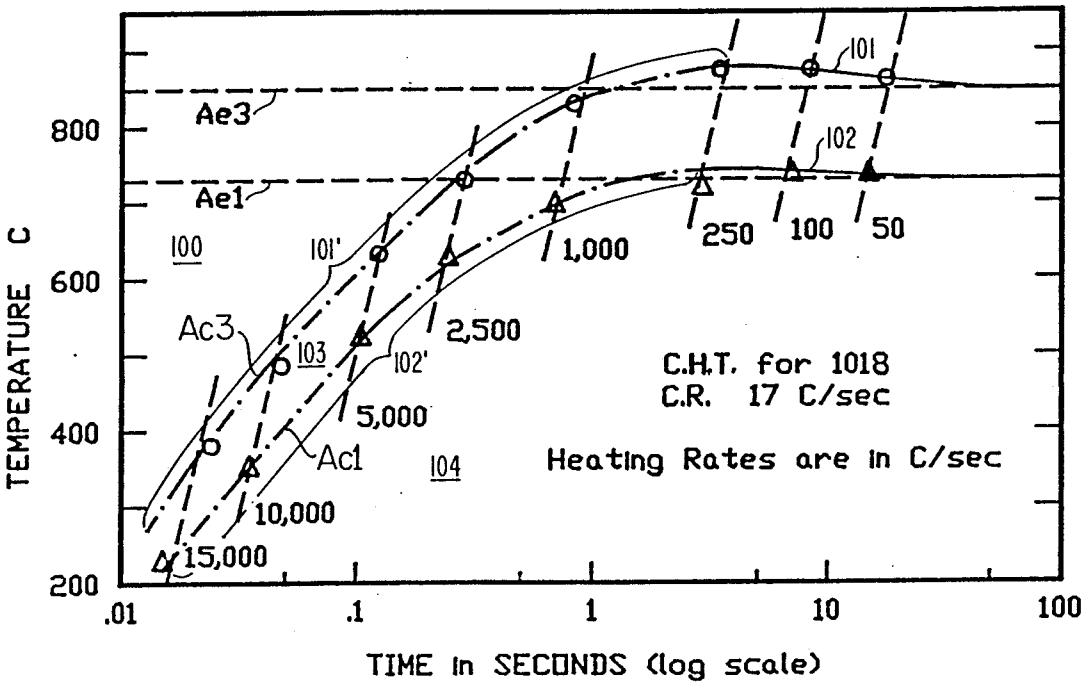
FIG. 2 shows a CHT diagram for type 1018 steel wherein the portion of the diagram known in the art and depicted in FIG. 1 is shown by solid lines, while the high heating rate portion of the diagram discovered by the applicant is shown by dot-dashed lines.
Figure 3:
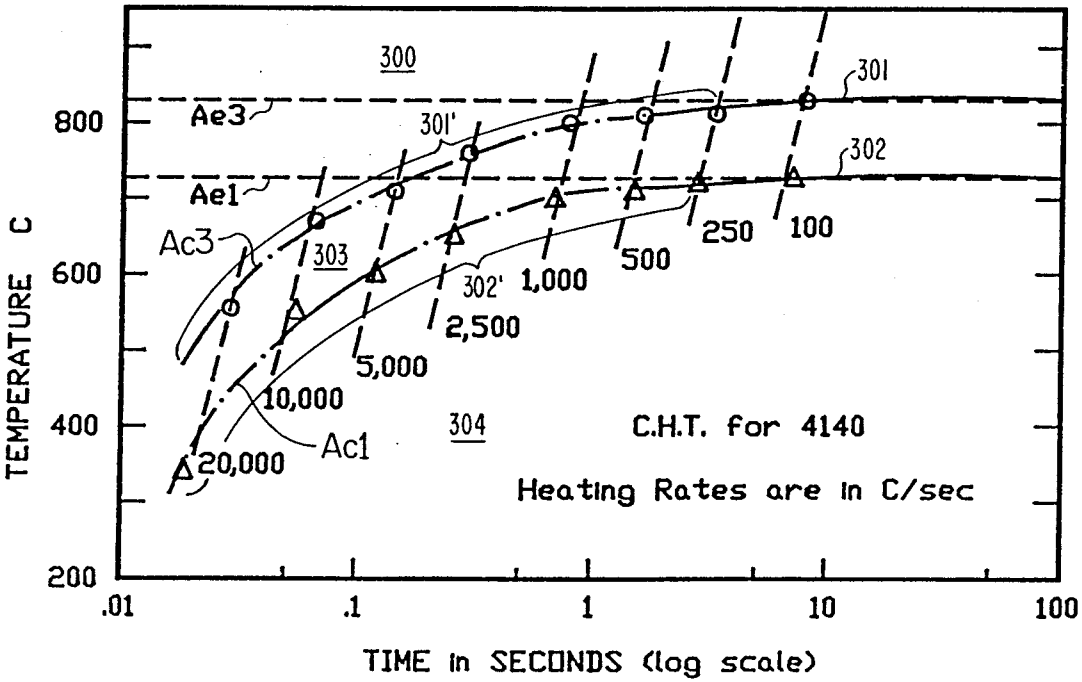
FIG. 3 shows a CHT diagram for a different alloy than that shown in FIG. 1, here a medium carbon low alloy type SAE 4140 steel, wherein that portion of the diagram known in the art is indicated by solid lines and that portion of the diagram discovered by the applicant is shown by dot-dashed lines.

This CHT diagram, as well as all the other CHT diagrams shown and discussed herein, was obtained through a suitably modified GLEEBLE 1500 single phase line frequency electrical resistance heating thermal/mechanical measurement system manufactured by Duffers Scientific, Inc. (which also owns the registered trademark GLEEBLE) located in Troy, N.Y. All specimens used by the applicant in generating CHT data consisted of a bar of a suitable steel alloy having a diameter of 12.7 millimeters (mm) that has been reduced at its midpoint to a diameter of 5 mm for a distance of 5 mm on either side of the midpoint. Both ends of each such specimen were held in copper wedge jaws which were, in turn, appropriately mounted, using suitable jacks, to the measurement system. Each specimen was approximately 70 mm long. To obtain CHT data, each specimen was heated electrically, using single phase 60 Hz line current, with the heat generated as a function of the amount of current passing through the specimen and the resistance of the specimen. The system used to control the temperature of the specimen was a standard commercially available GLEEBLE 1500 system that has been modified by suitably changing a temperature linearizer module used in the system (module number 1532) such that it performed a temperature averaging measurement every half cycle of line frequency. Each measurement was timed to occur when the value of the single phase sinusoidal heating current was zero. The heating rates shown in FIGS. 1–3 are bulk rates, as measured by surface mounted thermocouples located at a mid-span of the specimen. Inasmuch as electrical and thermal currents flowed axially in the specimen, planes taken through the specimen and oriented perpendicular to the axis of the specimen were substantially isothermal regardless of heating rate. As such, a surface mounted thermocouple provided a good measurement of the temperature of any point located on the isothermal plane on which the thermocouple was mounted. Changes in structural size of the specimen due to the transformation were measured on the isothermal plane which included the thermocouple for measurement and control of temperature. Due to the single phase alternating current (AC) heating system employed in the GLEEBLE 1500 system, the actual instantaneous heating rate occurring during any particular half cycle of heating current was much higher, generally on the order of approximately 2 to 2.5 times higher, than the measured bulk heating rates. The heating rates shown in these figures are depicted by dashed lines with the values in degrees C./second. The time, shown along the x axis of each of these figures, is the minimum length of the heating interval necessary to induce the transformation. Each specimen was heated from room temperature (approximately 20 degrees C.). The transformation temperature on rapid heating depends upon the amount and rate of energy imparted to the specimen.

Prior to obtaining CHT data on the 1018 steel specimen, the specimen was heated to 950 degrees C. and then held at that temperature for 20 seconds. Thereafter, the sample was then cooled at a linear cooling rate (C.R.) of 17 degrees C./second.

Now, as shown in FIG. 1, the structure of 1018 steel existing at room temperature would lie in region 104 and would consist of ferrite and pearlite. The equilibrium transformation temperatures are labelled Ae1 and Ae3. Curve 102 indicates the beginning of the transformation and hence represents the Ac1 (lower transformation) temperatures on heating. Curve 101 indicates the end of the transformation and hence represents the Ac3 (upper transformation) temperatures on heating. When the steel is heated to a temperature above curve 101 and hence into region 100, the steel will assume an austenitic structure. If, however, the steel is heated to an intermediate temperature situated between curves 101 and 102 and hence within region 103, then the structure will become two phase and only a portion of which will have transformed to austenite. It is well documented in the art that for relatively low heating rates (H.R.), approximately 100 degrees C./second and below, both the Ac1 and Ac3 transformation temperatures will generally rise as shown in FIG. 1. Therefore, it has been widely believed in the art that the transformation on heating is controlled by a diffusion process wherein the transformation temperatures would continue to increase with increasing heating rates. Specifically, see, for example, Y. Lakhtin, *Engineering Physical Metallurgy* (c. 1965: Gordon and Breach, New York) which states on page 161:

> "Upon continuous heating at various rates . . . pearlite is transformed into austenite . . . , not at a constant temperature but in a certain temperature interval . . . . *The higher the heating rate, the higher will be the temperature of the transformation.*" [emphasis added].

A similar view appears in E. J. Teichert, *Metallography and Heat-Treatment of Steel (Ferrous Metallurgy—Volume III)* (c. 1944: McGraw-Hill Book Company, Inc.; New York) which states on page 137:

> *"The constitutional [phase] diagram shows the position of the critical points under conditions of extremely slow heating or cooling and does not indicate their position when any other rate is employed. It is found that, when rates different from those specified under the conditions of the diagram are employed, the critical points do not occur at the same temperature on heating or cooling. This lag in the attainment of equilibrium conditions is termed hysteresis, which implies a resistance of certain bodies to undergo a certain transformation when this transformation is due. Therefore, the Ac point occurs at a temperature somewhat higher than would be expected. Similarly, the Ar point is somewhat lower. This difference between the heating and cooling criticals varies with the rate of heating or cooling. In other words, the faster the heating the higher will be the Ac point, and the faster the heating the higher will be the Ac point, and the faster the cooling the lower will be the Ar point."* [emphasis added].

In additional, similar teachings also appear on page 28.2 of the desk edition of *The Metals Handbook* (c. 1985, American Society of Metals; Metals Park, Ohio), on page 189 of C. Keyser, *Basic Engineering Metallurgy—Theories, Principles and Applications* (c. 1959: Prentice-Hall, Inc.; Englewood Cliffs, N.J.) and on pages 80–81 of L. Guillet et al, *An Introduction to the Study of Metallography and Macrography* (c. 1922: McGraw-Hill Book Company, Inc.; New York). Now, practically speaking, this belief in the art implies that the steel must be heated to increasingly higher temperatures in order to obtain transformations in increasingly shorter periods of time.

The applicant has discovered, contrary to widely believed and accepted knowledge in the art, that both the Ac1 and Ac3 transformation temperatures do not increase, as was previously thought, but instead substantially decrease as the heating rate increases above 250 degrees C./second.

This discovery is clearly shown in FIG. 2. This figure shows a CHT diagram for type 1018 steel obtained by applicant, in the manner set forth above. The portion of the diagram known in the art, that is partially depicted in FIG. 1, is shown by solid lines. The high heating rate portion of the diagram discovered by the applicant is shown by dot-dashed lines: line 101' and 102' for transformation temperatures Ac3 and Ac1, respectively. From this figure, it can be clearly seen that both the upper and lower transformation temperatures begin to decrease in value at a heating rate of 250 degrees C./second. This decrease becomes substantial as the heating rate rises.

As shown, if the specimen is heated at a rate of 10,000 degrees C./second, the Ac1 temperature lies below 400 degree C. and the Ac3 temperature is approximately 500 degrees C. This compares to transformation temperatures of approximately 825 and 800 degrees C. using respective heating rates of 250 and 1,000 degrees C./second. Hence, when the specimen is heated at 10,000 degrees C./second to a temperature of 550 degrees C., the specimen will exist in region 100 and be fully austenitic (fcc). Either holding the specimen at 550 degrees C. or cooling it at a modest rate therefrom will produce a soft ductile structure with excellent working properties. If heating proceeds at a rate of 10,000 degrees C./second and then stops when the material reaches a temperature of 400 degrees C., the resulting material will exist in two phase region 103. Consequently, only part of the low temperature products will have transformed to austenite. Now, if a heating rate of 15,000 degree C./second is used instead, then the specimen will be fully austenitic at a temperature of only 400 degree C. At this temperature, carbon steels held in air for a few seconds develop only a very thin layer of surface scale. Therefore, for most purposes, little, if any, surface cleaning would be required.

Alternatively, as the diagram in FIG. 2 indicates, if heating rates higher than 15,000 degrees C./second are used, then the maximum transformation temperature could probably be reduced to perhaps 250 to 300 degrees C. At these relatively low temperatures, carbon steels develop no surface scale and hence no surface cleaning would be necessary.

FIG. 3 shows a CHT diagram, obtained in the manner set forth above, for a specimen of a different steel, here SAE 4140 which is a medium carbon low alloy steel. The portion of this diagram known in the art is indicated by solid lines, line segments 301 and 302 for respective upper and lower transformation temperatures, Ac3 and Ac1, and that portion of the diagram discovered, by the applicant is shown by dot-dashed lines, line segments 301' and 302' for respective transformation temperatures Ac3 and Ac1. Region 300 is the austenitic region, region 303 is the two phase region and region 304 represents those low temperature products (bcc structures) that are stable at room temperatures. The exact low temperature products will depend upon the prior heat treatment, particularly the cooling procedure, used to reduce the temperature of the specimen from austenitizing region 300. The trends in the Ac1 and Ac3 transformation temperatures depicted in the curves shown in FIGS. 2 and 3 are different for heating rates below 250 degrees C./second. Specifically, in FIG. 2, both the Ac1 and Ac3 temperatures for 1018 steel increase with increases in heating rates up to 250 degrees C./second. No such increase is seen in the CHT curves shown in FIG. 3 for 4140 steel. The results existing for heating rates below 250 degrees C. agree with those expected from presently accepted theory. However, the results for higher heating rates, as is the case with the curves shown in FIG. 2, stands in direct contrast, as discussed above, to that presently believed and widely accepted in the art. All these results have been confirmed by dilation measurements of the specimen made by the GLEEBLE system. Specifically, these measurements entailed measuring the changes in the diameter occurring across an isothermal section in the specimen as the specimen transformed from a bcc to a fcc and back to a bcc structure.

As a result of this discovery, the applicant has recognized that transformations can be induced at high heating rates and relatively low temperatures thereby significantly, if not totally, eliminating the development of surface scale and the need for conventional annealing and scale removal. In essence, the transformation is induced to occur at a low (depressed) temperature in certain allotropic materials by imparting the proper amount of energy at a high rate to the material.

High heating rates can be generated by rapidly deforming materials using, for example, rolling, extruding or forging processes. Specifically, to reduce the thickness of steel strip, the strip is deformed beyond its elastic limit by expending mechanical energy to force it through rolls. Some of the mechanical energy applied to the steel is utilized in actually deforming the material, i.e. overcoming the inherent binding energy of a crystalline structure. Another portion of the energy is used to overcome the friction between the steel being deformed and the rolls. A large amount of this energy is converted to heat. In rolling or extruding processes, where the tooling is located against the surface of the strip, the heat expended in sliding friction is partly transferred to the rolls and the remainder is transferred to the strip. The art teaches that this heat must be removed, often by flood lubrication in which water, a water-soluble oil and water, or mixture of oils and water is directed against both the rolls and the surface of the strip in order to prevent the temperature of the rolls and that of the steel strip from rising appreciably to the point at which the strip will stick to the rolls, the strip will change metallurgically or the strip will oxidize.

Now, in accordance with the teachings of applicant's invention, the temperature of the tooling is maintained at an elevated temperature, so that only a limited amount of heat that is generated by a deformation process is removed from the material (e.g. strip, sheet or wire) as it passes through the tooling. If cold rolling is being used, then, contrary to accepted practice in the art, the temperature of the rolls is allowed to be considerably warmer than the entering strip and only sufficient cooling is provided to maintain the rolls at a desired elevated temperature. In starting the cold rolling process, heat may be supplied to the rolls by an external source in order to bring the rolls to the desired elevated temperature before cold rolling begins. Only enough lubricant is applied to the rolls to prevent the strip being rolled from sticking to the rolls but not enough lubricant is used to cool the rolls below the desired temperature. As a result, the deformation imparted by the rolls to the strip and the friction between each roll and the strip causes the temperature of the entering strip to rise very rapidly as the strip passes through the rolls. As discussed in detail below, the mill parameters—amount of reduction, roll speed, roll size, amount of lubricant applied to the rolls, roll temperature and temperature of the entering strip—are all appropriately adjusted, in a manner appropriate to the particular mill being used, to rapidly deform the steel strip and thereby impart a very high heating rate to the strip which, in turn, depresses the transformation temperatures of the steel.

Figure 4:
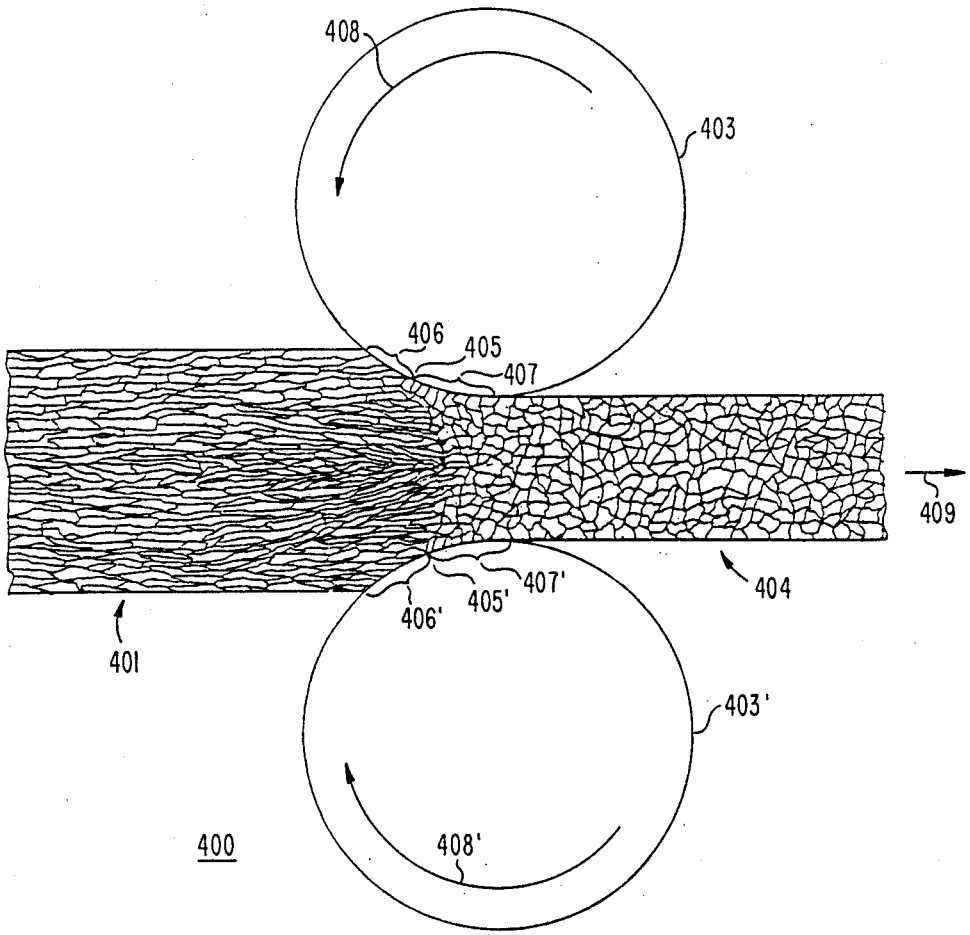
FIG. 4 is a simplified side elevation view of one embodiment of applicant's inventive apparatus, specifically a single two high roll stand, as it produces applicant's inventive material containing fully equiaxed grains throughout the material.

FIG. 4 depicts a simplified side elevation view of single two high rolling stand 400 used in producing applicant's inventive material. Arrow 409 indicates the direction in which strip 401 passes through the roll stand. The direction in which rolls 403 and 403' rotate is indicated by arrows 408 and 408'. This strip is reduced by approximately 40% as it passes through the rolls. As strip 401 enters rolls 403 and 403', it is reduced in cross-section thereby and thereafter exits roll stand 400 as strip 404. As shown, strip 401 has been cold worked prior to entering the rolls by passing it through one or more cold roll stands. The prior cold working is evidenced by the heavily deformed and elongated (banded) grains existing throughout strip 401. Points 405 and 405' (which are lines across the rolls and the strip) are the neutral points. At the neutral point, the speed of strip and that of the surface of each roll are the same. In regions 406 and 406', the surface speed of the strip is slower than the surface speed of roll 403 and 403', respectively. In regions 407 and 407', the surface speed of the strip is faster than the surface speed of either roll. Hence, there is considerable sliding of the roll and strip surfaces in regions 406 and 406' and again in regions 407 and 407'. With the heavy pressure exerted by the rolls onto the strip, this sliding generates a large amount of heating due to sliding friction between these surfaces. As discussed above, it is common practice in the art to reduce this friction by spraying lubricants onto the roll surface and the strip entering the roll stand. Here, however, the sliding friction is beneficial in generating high heating rates in the strip. Therefore, no lubricant is used to minimize this friction except in instances to prevent the strip from sticking to either roll in which case only a minimal amount of lubricant is used.

Now, while rolls 403 and 403' roll strip 401, the temperature of both rolls will increase due to the heat generated from the strip itself as it is being deformed and also from the heat caused by sliding friction. The art teaches that the rolls are to be cooled, typically by water or lubricant sprays, to prevent their surface temperature from rising. In contrast and in accordance with the teachings of the present invention, the roll is preheated to or allowed to rise to or just above the desired end rolling temperature, which is generally several hundred degrees C. The exact end rolling temperature depends upon the particular heating rate used which, in turn, is governed by the rate at which strip 401 is deformed by the rolls. Generally, in accordance with the teachings of the present invention, the roll speed is suitably adjusted, for given values of the other mill parameters, to yield thermal heating rates in the strip due to deformation and sliding friction of tens of thousands of degrees C. per second.

Specifically, the speed of rolls 403 and 403' can easily be adjusted to provide the desired instantaneous heating rate and hence transformation depth. This is evident in various tests actually conducted by the applicant. To conduct these tests, the applicant constructed a two high sample rolling mill that used rolls that were 20 inches (approximately 50.8 centimeters) in diameter. With this mill, a specimen of low carbon steel (0.08% carbon) strip was first reduced by 50% from a thickness of 0.120 inches (approximately 0.3 centimeters) to 0.06 inches (approximately 0.15 centimeters) using a conventional cold rolling operation. Thereafter, the rolls of this mill were heated to a surface temperature of approximately 300 degrees C. using gas radiant heaters. The speed of the rolls was adjusted to yield a surface speed of 3000 feet/minute (approximately 914 meters/minute). The roll gap was set to reduce the thickness of the strip from 0.06 inches (0.15 centimeters) to 0.03 inches (approximately 0.076 centimeters). With these settings, the contact distance between each roll and a corresponding surface of the specimen was approximately 0.7 inches (approximately 1.8 centimeters). Inasmuch as the reduction in thickness of the specimen was approximately 50%, the speed at which the specimen exited the rolls, 3750 feet/minute (approximately 1143 meters/meters) was, as expected, approximately 25% faster than its entry speed. These surface speeds are typical of those used in a modern cold rolling mill. In fact, some modern cold mills currently use exit speeds of approximately 6000 feet/minute (approximately 1,829 meters/minute). In any event, the surface speed of 3000 feet/minute provided 0.0016667 seconds/inch (approximately 0.000656 seconds/centimeter) of contact between each surface of the specimen and a corresponding roll. As such, the contact time was 0.00116 seconds. Once the operating parameters of the sample mill reached these desired values, the cold reduced 0.060 inch thick specimen was injected into the mill. If, during the ensuing test rolling operation, the temperature of material located in a surface region of the specimen rose 200 degrees C., this would correspond to a heating rate of approximately 180,000 degrees C./second. With such a heating rate, the resulting temperature in the surface region of the specimen would be expected to increase above the depressed Ac3 temperature at which point transformation of material located in this surface region would occur. Such transformation of the surface region did actually occur as is clearly evident in FIGS. 12 and 13.

Figure 12:
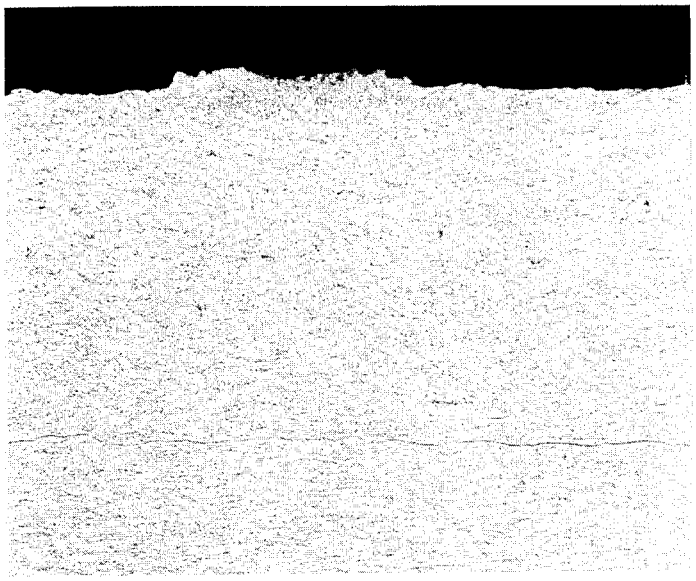
FIG. 12 is a photomicrograph, taken at a magnification of 125×, of a portion of a cross-section of a test specimen, having a transformed surface and non-transformed core, produced by an actual rolling operation that was conducted in accordance with applicant's inventive method.

FIG. 12 shows a photomicrograph of a portion of a cross-section of the specimen, having a transformed surface region and a non-transformed core, after the test rolling operation occurred. This photomicrograph was taken at a magnification of 125× with a 2% nital etch used to enhance grain depiction of the specimen. As seen in this photomicrograph, the roughness of the upper surface indicated that some surface sticking occurred between the surface of the specimen and one of the rolls. Roughness such as this in a strip can be easily eliminated by passing the roughened strip through a subsequent roll stand that imparts a very light skin pass to the strip before the strip is coiled.

Figure 13:
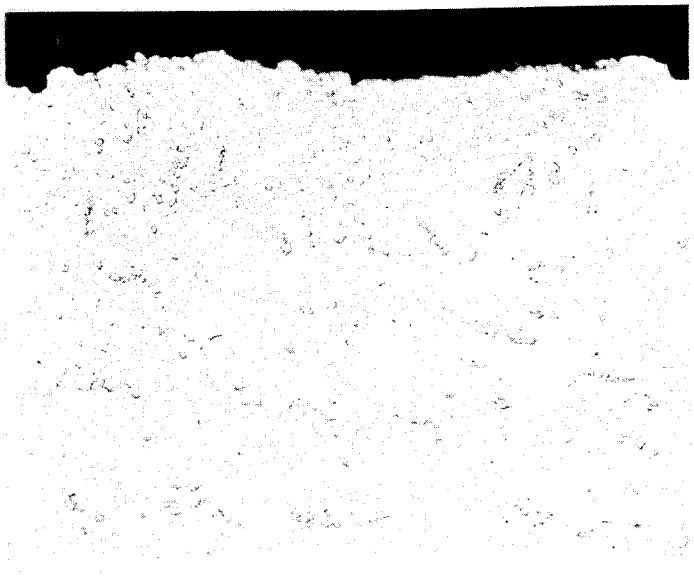
FIG. 13 is a photomicrograph, taken at a magnification of 500×, of the transformed region of the same specimen shown in FIG. 12.

The transformed surface region of the specimen shown in FIG. 12 is clearly evident in FIG. 13. This figure shows a photomicrograph, taken at 500× magnification, of the transformed surface region of this specimen. The thickness of the transformed region is between 0.0001 and 0.0002 inches (0.0025–0.0051 centimeters). The temperature of the material that existed within the specimen at a depth greater than 0.002 inches from the transformed surface did not reach the Ac3 or Acl temperature due to the limited amount of deformation imparted by the rolls and prior cold work to the specimen. As such, the transformation did not reach to a depth beyond 0.002 inches from the transformed surface. The hardness of both the transformed and non-transformed material within the specimen was measured on a microhardness testing machine by indenting the specimen using a diamond indenter with a 50 gram load. As measured, the hardness of the material occurring 0.015 inches (approximately 0.038 centimeters) from the transformed surface, i.e. at the center (core) of the specimen, was 178 HV 50. The hardness of the material at a depth of 0.0005 inches (approximately 0.0013 centimeters) from the surface was measured at 66 HV 50. These measurements are in Vickers Hardness (HV) where the first number indicates the measured hardness value (i.e. 178 or 66) and the second (i.e. 50) indicates the load in grams used in the measurement. As such, the core of the specimen was more than 2.5 times as hard as the transformed surface region. A deeper penetration of the specimen by the transformation could be achieved through use of an increased deformation rate which imparts a increased amount of energy into the material through deformation and expends a lessened amount of energy in sliding friction. An increased deformation rate can be produced by using rolls that have a smaller diameter than that actually used on the sample mill, i.e. rolls with less than a 20 inch diameter. If rolls were to be used that had a diameter of 5 inches (approximately 12.7 centimeters), then the deformation rate would increase by a factor of 4 without increasing the surface speed of the strip. The applicant has observed that the deformation rate appears to behave in a fashion similar to that of an instantaneous heating rate. Therefore, the deformation rate must be set to yield an instantaneous heating rate of more than 2 or 2.5 times the bulk or mean value heating rate specified by the CHT curve of the material being produced. Moreover, increasing the temperature of the rolls will only increase the surface temperature of the strip by a small amount due to the very short contact time between the rolls and the strip.

As noted, only the surface region of the specimen transformed as the result of the test rolling operation. This was due to an uneven temperature distribution that appeared across the thickness (cross-section) of the specimen. The temperature at or near the surface was higher than that in the core of the specimen. In this case, the material in the core did not transform to austenite. This behavior is diagrammatically shown in FIG. 5. Here, strip 501 has been rolled by rolls 403 and 403' to produce strip 504. This strip has regions 510 and 510' extending beneath respective surfaces 512 and 512' and containing equiaxed grains, such as grains 515 and 515' respectively. This strip also has a cold worked core 511 containing elongated grains, typified by grain 518. To produce this strip, the rate of deformation and the exiting temperature of the strip are adjusted so that the surface material of the strip fully transforms, i.e. goes above the Ac3 temperature, and the material in the core does not transform, i.e. remains below the Ac1 temperature.

Figure 5:
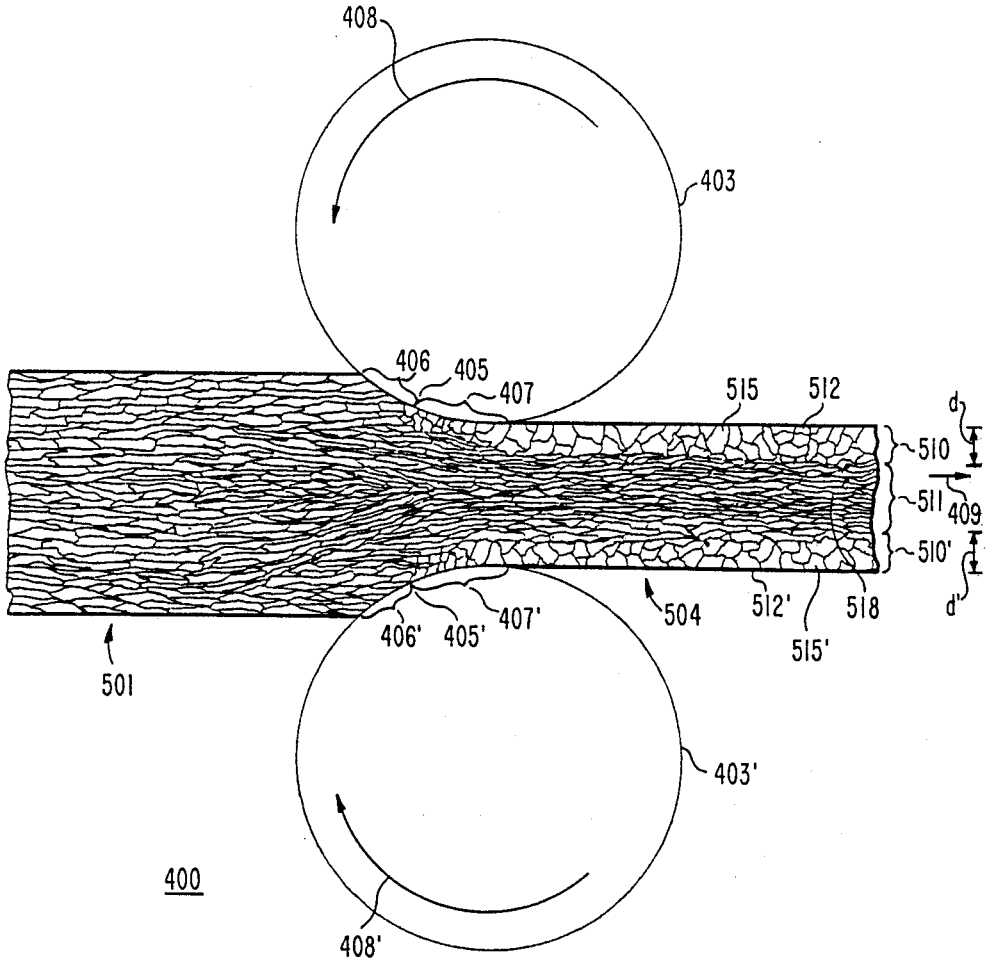
FIG. 5 is a simplified side elevation view of applicant's inventive apparatus shown in FIG. 4, i.e. a single two high rolling stand, as it produces applicant's inventive material containing equiaxed grains extending to a pre-defined depth below each surface of the material and elongated (banded) grains in the core of the material.

Although material 501 shown in FIG. 5 is depicted as having a deformed crystalline structure, specifically being a cold worked (banded) structure, material 501 can also be equiaxed structure which can be deformed by the inventive process to provide a core that is banded and a surface that is equiaxed. Alternatively, material 501 may be a structure that has a relatively high internal energy, such as martensite or bainite. When such a material is deformed in accordance with the teachings of the invention, strip 504 may contain an equiaxed structure near its surfaces while retaining original martensitic or bainitic material in the core.

Inasmuch as the thermal conductivity of the rolls and the strip is relatively low, the heating will occur where energy is expended. Hence, if the deformation is nearly uniform across the cross-section of the strip, the energy of deformation will be essentially uniformly distributed throughout the entire cross-section of the strip. However, energy dissipated in overcoming the friction between the strip and the rolls will be concentrated in the surface regions of the strip. As a result, the frictional energy when added to the bulk heating caused by deformation will cause the temperature of the surfaces of the strip to rise more rapidly than that of the core. Consequently, the material situated in surface regions 510 and 510' of strip 504 will reach a higher temperature, such as the Ac3 temperature, before core 511 does. Therefore, these surface regions will transform sooner than the core. However, by reducing the sliding friction and increasing the amount and rate of deformation, by for example using small diameter rolls, rapid heating will penetrate the material to a increasingly deeper depth from the surface regions thereby causing progressively deeper portions of the strip to reach the Ac3 temperature and subsequently transform. If the temperature of the entire strip increases beyond the Ac3 temperature, then the entire cross-section will be transformed into equiaxed grains, as shown in FIG. 4. If, however, the heating is prematurely terminated, then portions of the strip, extending to a certain depth, i.e. distances d and d' as shown in FIG. 5, below each surface will probably reach the Ac3 temperature and transform while the core will not reach the Acl temperature. As a result, the surface regions of the material will transform into equiaxed grains and become relatively ductile; while, the core will retain banded grains having a relatively high yield strength.

Advantageously, in accordance with the teachings of the invention, the yield strength and ductility of the material can be set within certain ranges by regulating the depth (distances d and d') reached by the transformation. The transformation depth can be set to any value between the surface, in which case little or no transformation occurs, to the mid-plane of the material, in which case the entire material will be transformed into an equiaxed grain structure. Inasmuch as the non-transformed core has a higher yield strength and lower ductility—those associated with cold worked structure—than the transformed surface, the depth to which the material has been transformed will dictate the resulting yield strength and ductility of the resulting material. Specifically, if the transformation only reached to a shallow depth, then the resulting material will predominantly consist of elongated deformed grains which provide a high strength material with a ductility similar to that typically associated with a cold worked strip. However, as the transformation depth increases toward the core, more of the material will become equiaxed thereby increasing its ductility over that of a fully cold worked structure. At the same time, the strength will correspondingly decrease, from that of a fully cold worked structure, as the cross-sectional area of the core decreases. Nonetheless, the existence of a deformed (banded) core of any cross-sectional area will produce a material having a higher strength than a completely equiaxed (fully annealed) structure. This increase in strength will typically range from 10%–35% depending upon the width of the core relative to that of the transformed equiaxed surface regions.

Figure 8:
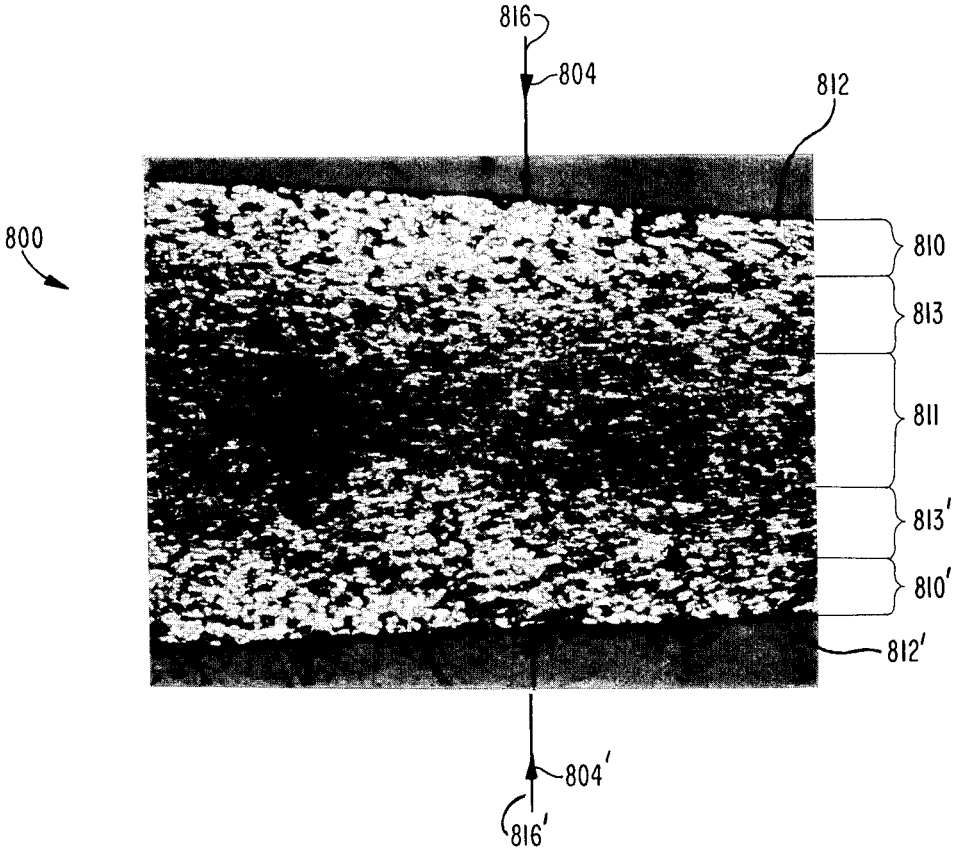
FIG. 8 is a photomicrograph of a cross-section of a specimen of the same base metal shown in FIG. 6 but after this specimen has been deformed in accordance with the teachings of the invention wherein an equiaxed grain structure extends inward from each surface to a pre-defined depth and a heavily cold worked banded structure exists in the core.

Now, as noted, the transformation depth can be regulated by controlling the time during which the strip is being heated. This heating time is a function of the amount of deformation—which is governed by the roll contact distance—and the roll speed. Of these parameters, an increased deformation rate is more easily obtained by using small diameter rolls than through adjustment of other mill parameters. Currently, very small diameter work rolls are often employed in some special cold rolling mills, such as a Sendzimir mill. Modern mills frequently use such small diameter rolls when cold rolling high strength materials. By appropriately choosing the values of the controlling parameters (roll diameter, roll temperature, roll speed and material thickness), the transformation depth can be pre-defined. As such, the yield strength and ductility of the strip can be set to desired values ranging between those associated with completely equiaxed grains and those associated with fully banded grains. In actuality, the transformation depth will vary somewhat around its pre-defined value throughout the strip—as shown in FIG. 8 —owing to localized changes in alloy chemistry and other characteristics in the strip.

The affect of changing the diameter of rolls 403 and 403' can be substantial. For a given reduction of strip 501, as the diameter of either roll increases more surface area of the roll will be in contact with a surface of the strip. Hence, the distance over which the rolls contact the strip, i.e. the roll contact distance, will correspondingly increase. This will increase the slip distance and the frictional heating. However, if both a large diameter roll and a small diameter roll are run at the same surface speed, then the deformation rate and the bulk heating rate produced by a large diameter roll will be less than that produced by a smaller roll for the same reduction.

The technology for using small rolls to roll strip is well developed. As the diameter of the rolls decreases, the deflection of the rolls correspondingly increases. The control of the deflection is accomplished by using suitable back-up rolls. Here, one or more back-up rolls would rotate against that roll (the "work roll") which is actually in contact with the sheet, such as in illustratively a Sendzimir type mill, and thereby increase the stiffness of the work roll.

As the diameter of rolls 403 and 403' decreases while their surface speed is maintained, then the deformation rate increases substantially. The limitation in reducing the diameter of the rolls is the deflection control of the roll and the angle of bite, i.e. where strip 401 (or 501) contacts the roll. If this angle becomes too large, then the strip will not feed properly into the rolls. If, however, the time during which the sheet contacts the rolls is held constant but the length of surfaces 406 and 407 (for illustratively roll 403) which contacts the strip decreases by ½, then the mean deformation rate increases by a factor of 2. Since the deformation rate determines the bulk heating rate, smaller roll diameters provide higher bulk heating rates for a given strip velocity than do larger rolls. However, as the roll diameter decreases, the area over which sliding friction occurs decreases and hence so does the amount of heating obtained through surface friction.

Consequently, on the one hand, to obtain transformation through the entire cross-section of the strip, a smaller diameter roll will provide more bulk heating and less surface heating, as well as, a higher heating rate than a larger roll. This will promote a more uniform temperature through the entire cross-section of the strip and likely cause the material existing throughout the entire cross-section to transform. On the other hand, the use of larger rolls will provide larger contact areas and hence larger amounts of friction. This will promote higher heating rates and higher temperatures near each surface of the strip thereby making transformation of the surfaces and surrounding areas easier while maintaining material in the core in a non-transformed state, such as that which occurred in the specimen shown in FIG. 8 as will be discussed in detail below.

Up to this point, the discussion has indicated that the deformation energy is distributed approximately equally between frictional heat and deformation heat. In the event that substantially more surface heating and less deformation heating are desired, then the neutral line extending between points 405 and 405' may be moved toward the exit point of roll stand 400—even to the point where the neutral line is no longer in contact with the material. In this case, the surface speed of rolls 403 and 403' would be greater than the speed of material 504. This would require one or more rolls located ahead of rolls 403 and 403' for controlling the speed of material 501 as it passes through roll stand 400. Under these conditions substantial surface heating would be possible while a very small amount of deformation is imparted to material 401.

Now, the rapid heating of the surface of the strip may be enhanced by maintaining the initial surface temperature of each roll at approximately the desired end temperature of the strip. Since exact control of the roll temperature is difficult to achieve in practice, the rolls may be maintained at any temperature lying in a band that extends between pre-defined temperatures above and below the desired end temperature of the strip, e.g. in a band ranging from 50 degrees C. below the desired end temperature to 100 degrees C. above it. Maintaining each roll at such an elevated initial temperature minimizes the amount of heat lost from the strip to each roll while the strip is being deformed. Now, alternatively, if either roll is at a much lower temperature than the strip, then the strip will be cooled by the roll. Even though the thermal transfer time between the strip and the roll is very short, the heat conducted into the roll during this time will reduce the heat generated by deformation of the strip and will, in turn, reduce the heating rate of the strip. However, if the roll is maintained at an elevated initial temperature, particularly near the desired end temperature of the strip, then little, if any, heat will be transferred to the roll from the strip during subsequent deformation. As a result, all the heat produced through deformation will heat the strip. Consequently, by eliminating these conduction losses into the roll, the heating rate of the strip will rise.

Figure 10:
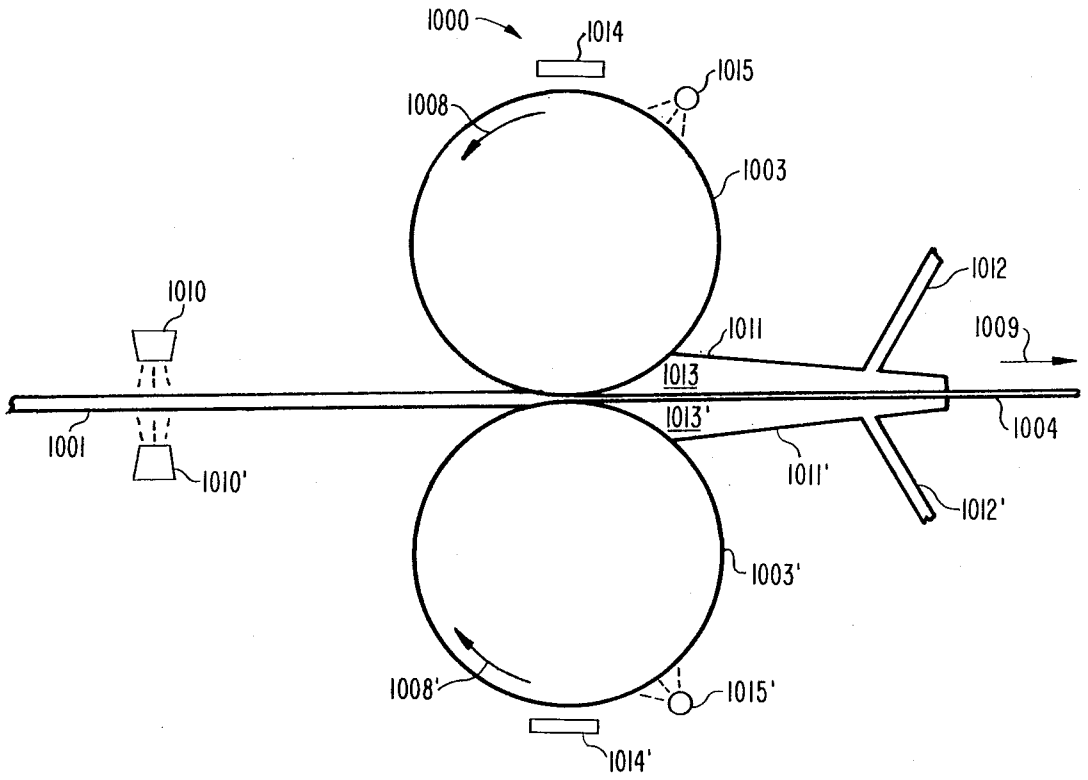
FIG. 10 shows a simplified side elevation view of another embodiment of applicant's inventive apparatus, specifically a single two high roll stand with peripheral shielding equipment.

The roll temperature may be readily controlled by initially heating the rolls, illustratively using induction or radiant heating, to an appropriate initial temperature prior to deforming any material. This advantageously minimizes the amount of material which must be placed through the rolls and then scrapped before the rolls reach their desired temperature. During production operation, the heat generated during rolling will usually maintain the rolls at the desired temperature. However, if the rolls tended to overheat then some form of cooling, such as an oil or water spray, must be provided to maintain the rolls at a desired temperature, as shown in FIG. 10 and discussed below. Now, alternatively, if the rolls are fabricated from a material that is a poor thermal conductor, such as ceramic, then the surface of the rolls may reach the desired temperature rapidly without the necessity of much, if any, preheating. Cooling would still be necessary only in the event the rolls begin to overheat. Furthermore, although the body of the roll may be predominantly steel, the material at and immediately below the surface may be fabricated from one or more carbides or other materials, such as tungsten carbide, silicon carbide and alumina, that possess an extremely high hardness and poor thermal conductivity. A roll surface manufactured from any of these materials will also reach operating temperature very quickly without the necessity of much, if any, preheating. The foregoing discussion of roll preheating and roll composition also applies to any tooling used in extrusion and forging (i.e. dies) when either technique is used, in lieu of rolling, to produce rapid deformation according to the inventive process.

Any such tooling, whether it is rolls or dies, must be fabricated from a material which will retain its surface hardness and other mechanical properties during use. Inasmuch as the tooling will reach and operate at an elevated temperature, as discussed above, a material must be selected for use at least in the surface of the tooling that will not lose its mechanical properties during continued operation at elevated temperatures. As noted, there are many commercially available high temperature materials which may be satisfactorily used for this purpose.

The friction generated by the rolls can be increased by roughening the surface of each roll through suitable machining. Any roll surface which is not smooth, i.e. textured, will produce more friction and frictional heating between it and the strip being rolled. Consequently, use of such rolls generates increased levels of surface heating in the strip being rolled and hence much higher heating rates near each surface of the strip than in the core of the strip. Any surface irregularities appearing in the strip resulting from the use of roughened rolls can be easily removed by running the strip through a light "skin" pass using rolls with polished surfaces in a final rolling stand.

Now, with the above discussion in mind, the applicant will now present and discuss additional observations he made in support of his invention.

Figure 6:
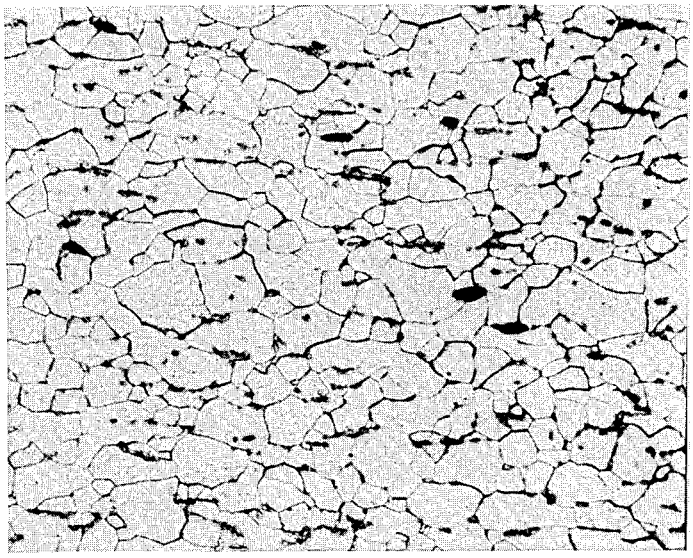
FIG. 6 is a photomicrograph of a cross-section of a specimen of a non-deformed base metal structure as it exists prior to cold rolling.

FIG. 6 is a photomicrograph of a cross-section of a specimen of a non-deformed base metal structure, here of 1018 steel, as it exists prior to cold rolling. This photomicrograph was taken at a magnification of 500×. A 2% nital etch was used to enhance grain depiction. As shown, the entire structure contains equiaxed grains. The mechanical properties of this specimen are essentially non-directional.

Figure 7:
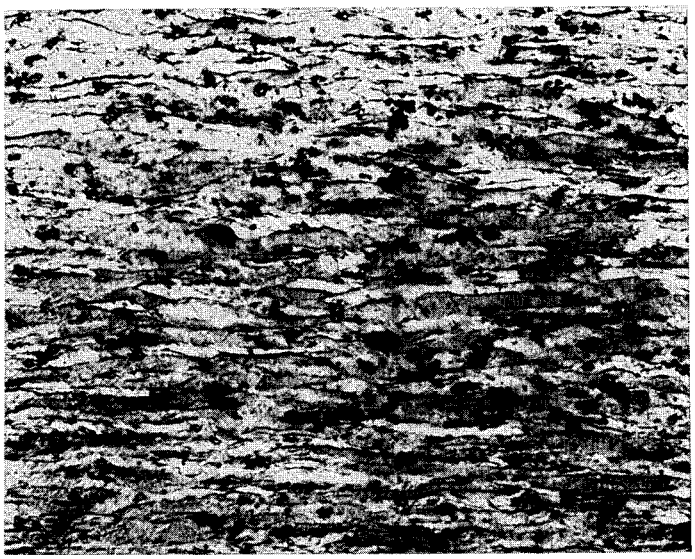
FIG. 7 is a photomicrograph of a cross-section of a specimen of the same base metal shown in FIG. 6 but taken after this metal has been reduced in thickness by approximately 80% by cold rolling.

FIG. 7 shows a photomicrograph of a cross-section of the same base metal depicted in FIG. 6 but taken after this specimen has been reduced approximately 80% in thickness by cold rolling. Again, this photomicrograph was taken at a magnification of 500× with a 2% nital etch used to enhance grain depiction. The mechanical properties of the elongated grains (banded structure) resulting from the deformation imparted by the cold rolling are very directional. Essentially, no recrystallization or transformation has taken place anywhere in this deformed structure. This deformed structure has a hardness value which is more than twice that of the equiaxed base metal shown in FIG. 6.

FIG. 8 depicts a photomicrograph of a cross-section of specimen 800 of the same base metal shown in FIG. 6 but after this specimen has been deformed in accordance with the teachings of the present invention, and specifically through high speed forging provided by the GLEEBLE 1500 system in the directions shown by arrowheads 804 and 804' against associated forging surfaces of the specimen. This photomicrograph was taken at a magnification of 100× after a 2% nital etch was applied over the cross-section to enhance grain depiction. Specifically, the deformation rate, sliding friction and temperature rise were sufficiently high and rapid to produce complete transformation in the specimen in surface regions 810 and 810' which include and extend beneath respective surfaces 812 and 812' towards core 811. The structure changes from soft equiaxed grains in surface regions 810 and 810' to the heavily elongated (banded) structure produced by the deformation. The sliding friction present at each surface caused sufficiently rapid heating to enable the material located there to exceed the Ac3 transformation temperature and hence completely transform. In contrast, the heating rate imparted to the material located within core 811 was insufficient to raise the temperature of the core beyond the Ac1 transformation temperature. Consequently, none of the material present in core 811 transformed. However, the heating rate present within regions 813 and 813' was sufficient to raise the temperature of the material in these regions past the Ac1 temperature but not past the Ac3 temperature. As a result, regions 813 and 813' are two phase regions and hence the material located here contains intermediate amounts of each structure, i.e. equiaxed grains and elongated grains. To produce the specimen, the applicant simulated the operation of a cold rolling stand on a specimen of SAE 1018 steel using the previously discussed GLEEBLE 1500 system, as modified by the applicant in the manner set forth above. This specimen was 3.2 mm thick, 5 mm wide and 7 mm high and compressed in the 3.2 mm direction. Specifically, the specimen was held using INCONEL 718 cylindrical anvils (INCONEL is a trademark of International Nickel Corporation) and the specimen was positioned such that rapid deformation, through high speed forging, was produced. Just prior to deformation, the anvils were preheated to 400 degrees C. and the specimen was freely suspended between the anvils. To provide sufficiently rapid deformation, the stroke rate provided by the GLEEBLE 1500 system was programmed to 1200 mm/second. This, in turn, produced a bulk heating rate of 24,000 degrees C./second as measured at the surface of the specimen by the GLEEBLE system.

Inasmuch as the metal that forms specimen 800 contains two fundamentally differently shaped grains, this specimen contains material existing at different energy levels. Elongated deformed grains possess considerable energy inasmuch as energy was added to the material first to overcome the inherent crystalline binding energies present in a bcc lattice structure, i.e. characteristic of a fully annealed structure, and then to plastically deform the crystals. This deformation significantly increases the density of dislocations present within the deformed structure over that existing in a soft fully annealed material and thereby considerably increases the internal strains within the deformed structure. Since equiaxed grains are not deformed, they are relatively stress free and possess far less energy than the deformed grains. Thus, from the structure shown in FIG. 8, the energy level in the grains that form core region 811 significantly exceeds that in the grains that form surface regions 810 or 810'. The energy level in two phase regions 813 and 813' lie intermediate between the levels for the core and the surface regions. This energy difference provides the high strength in the core and the ductility and good formability in the surface regions. The art is simply not able to create a multi-energy level structure in the manner taught by the applicant. This result has occurred for the reason that a principal process that has heretofore been known in the art for producing stress free low energy (equiaxed) grains has been annealing. Strip annealing is generally not designed to provide localized transformations as does applicant's inventive process. Specifically, annealing, such as batch or continuous, may rely on raising the bulk temperature of the strip, throughout its entire cross-section, above the Ac3 temperature in order to generate a completely transformed structure throughout the strip. As a result, the entire strip being annealed transforms to its lowest free energy state, which is an equiaxed structure. No deformed grains exist in a fully annealed material. Selectively transforming the strip down to a predetermined depth beneath each of its surfaces, as taught by the applicant, is very difficult to obtain using present knowledge in the art. In particular, annealed materials which are subjected to a large induced strain have an unfortunate tendency to fracture. When annealed materials fracture, the fractures begin as cracks at the surface and propagate inward towards the core which, in turn, fractures. However, such fracturing is unlikely to occur in applicant's inventive material. Specifically, the material in the core is under considerably more stress than the material in the surface regions. Hence, the resulting strain generated in the core during cooling places these surface regions in a state of compression. This, in turn, prevents the surface from fracturing at low yield strengths which would otherwise be characteristic of fully annealed materials whenever large strains are induced therein. Moreover, deformed crystal structures which have high internal energy and are located at a surface of a material are prone to corrosion. Advantageously, the low internal energy inherent in the transformed surface of applicant's inventive material improves the corrosion resistance of this material.

Figure 9:
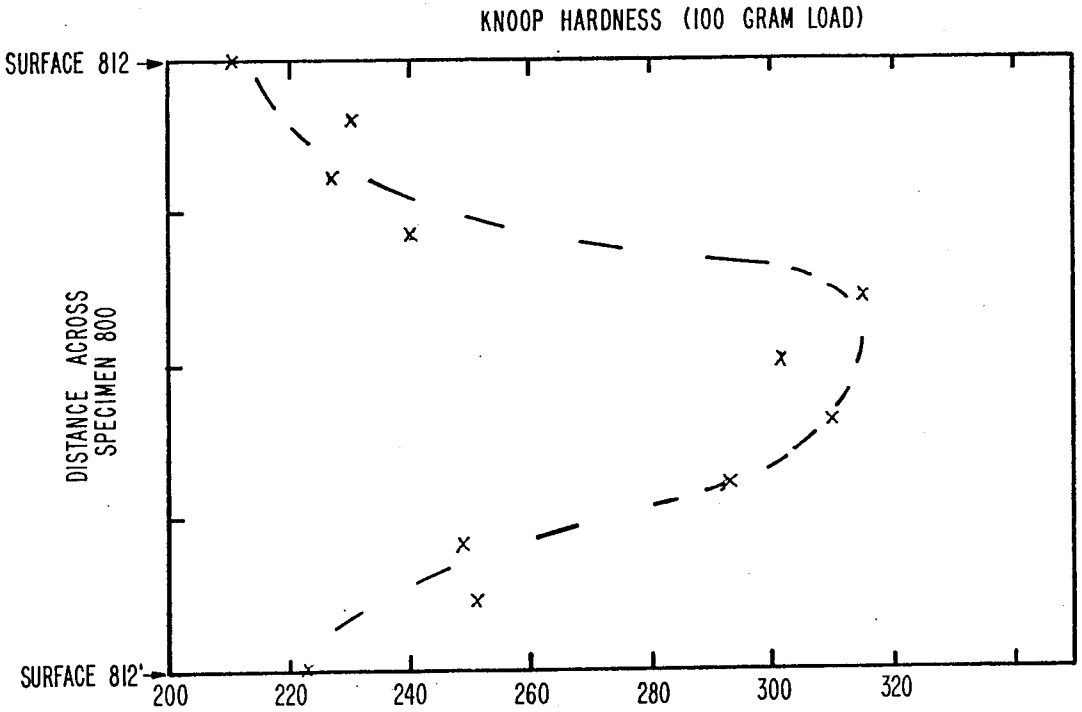
FIG. 9 shows a profile of microhardness values, obtained through testing the specimen shown in FIG. 8 using the Knoop microhardness test, plotted as a function of the distance across the specimen.

FIG. 9 is a profile of microhardness values of specimen 800, taken along microhardness traverse line 816–816' shown in FIG. 8, plotted as a function of the distance across the specimen. Surfaces 812 and 812' of specimen 800 correspond to the top and bottom edges of the profile, as shown. The hardness values shown in this profile have been obtained through testing this specimen using the Knoop microhardness test with a 100 gram load. Clearly, the hardness of the material that forms specimen 800 is much lower near either surface 812 or 812'. The hardness of the material located in core 811 approximately equals the hardness of SAE 1018 plain carbon steel that has been reduced by approximately 90% by cold working. However, the hardness of the material near either surface is somewhat higher than that associated with a fully annealed type SAE 1018 plain carbon steel. Since the strength of the steel is proportional to its hardness, the strength of the material located near either surface of specimen 800 is lower than the strength of the steel in the core. Now, viewed differently, the ductility of the steel is higher at lower hardness values and lower at higher hardness values. Consequently, the ductility of the material located near either surface 812 or 812' of specimen 800 is greater than the ductility of the material existing within core 811. The ductility and hardness of the material existing within two phase regions 813 and 813' lie intermediate to the values associated with core 811 and surface regions 810 and 810'. As such, this material shown in FIG. 8 advantageously provides both good surface ductility and a high strength core. This permits a material having both good formability and high strength.

A low carbon steel strip, that has been strengthened in accordance with applicant's invention, can be produced by one stand in a multi-stand cold rolling mill or in a single stand mill. For example, the fourth stand in a five stand mill could be appropriately adjusted to produce the desired transformations in the surface regions of the strip while the strip passes through this stand. If the inventive alloy were to be produced in this fashion, then the alloy would be ready to use as it emerges from the rolling mill. No heat treatments, such as annealing, would be necessary. Moreover, since the transformations occur at temperatures of only several hundred degrees C., minimal, if any, surface scale would appear on the transformed strip. Such scale, if it appears at all, is very easy to remove with minimal equipment using conventional light pickling processes. Alternatively, a gas shield may be used to prevent surface scaling, as discussed in detail below.

What little surface scaling and/or surface discoloration might be produced using the above apparatus could be effectively prevented from occurring by using the inventive apparatus depicted in FIG. 10 which shows a simplified side elevation view of single two high roll stand 1000 with peripheral shielding equipment. Here, strip 1001 enters roll stand 1000 which contain rolls 1003 and 1003' rotating in the direction indicated by arrows 1008 and 1008', respectively. Strip 1001 may have been previously cold worked by a prior roll stand. The reduction imparted to strip 1001 as it passes through roll stand 1000, specifically between rolls 1003 and 1003', is usually not more than 40%. The speed and diameter of rolls 1003 and 1003' are both chosen to produce the desired high heating rate in strip 1001 during its deformation, as explained above. The reduced strip emerges from roll stand 1000, in the direction shown by arrow 1009, as strip 1004. To ensure that strip 1001 has an appropriately low temperature prior to entering roll stand 1000, cooling nozzles 1010 and 1010' span the width of the strip and are used to apply a suitable coolant to the strip. The coolant may be an appropriate gas, liquid or both. Now, detrimental scaling and/or surface discoloration can be substantially prevented by enclosing the heated strip as it emerges from roll stand 1000 in a non-oxidizing atmosphere until the strip has cooled to a temperature where it will no longer oxidize, i.e. form scale or surface discoloration. To provide this, manifolds 1011 and 1011' shroud strip 1004 as it emerges from between rolls 1003 and 1003' These manifolds are respectively filled with a suitable shielding gas, such as nitrogen or an inert gas, via connections 1012 and 1012'. The gas fills upper area 1013 and lower area 1013' contained within respective manifolds 1011 and 1011' thereby blanketing both the top and bottom surfaces of strip 1004 as the strip travels between the manifolds. As a result, this gas effectively prevents the warm strip from oxidizing until it emerges from the manifolds where, by that point, it will have cooled to a temperature below which detrimental scaling or surface discoloration will occur. The gas applied to strip 1004 may also cool the strip somewhat. In the event a non-shielding gas is to be used to provide cooling instead of shielding, then the former can also be directed to strip using manifolds 1013 and 1013' in the manner as described above.

The initial temperature of rolls 1003 and 1003' may be increased to a desired operating level, prior to initiating any deformation, by heating the surface of the rolls using respective induction coils 1014 and 1014'. Each induction coil runs parallel to the surface of its associated roll (coil 1014 for roll 1003) and extends throughout the entire length of the roll. In this manner, each induction coil, when energized, will produce a uniform temperature in the surface of its associated roll while that roll is being turned before any deformation begins. Alternately, radiant gas or electric heaters may be used in lieu of induction heaters. The core of each of these rolls may be water cooled to prevent the roll support bearings from overheating during deformation. These bearings must be able to withstand high speeds and heavy loads present in this type of rolling operation. The bearing assemblies and their associated bearing mounts may be any one of many suitable types that are presently in use in the rolling industry. In the event the temperature of rolls 1003 and 1003' rises to an excessively high level, a suitable coolant, such as an oil or water spray, can be directed to the surfaces of the rolls by pipes 1015 and 1015', respectively. Each pipe runs approximately parallel to and extends to the full length of its associated roll. Coolant would only be applied to the rolls to hold the surface of each roll at a desired temperature, preferably higher than the exit temperature of strip 1004 as it leaves the rolls.

Now, if rolling a material above its Ac1 and Ac3 temperatures is considered to be hot rolling and rolling the material below its recrystallization temperature is considered to be cold rolling, then the inventive process may be considered to be rolling at an intermediate temperature with the proviso that the temperature of the material entering the rolls must be at a low temperature, preferably at or near room temperature. The final rolling temperature is below the normal recrystallization temperature range of the material.

Now, as one can now appreciate, any material that undergoes allotropic transformations and exhibits depressed transformation temperatures upon rapid heating, such as any low carbon steel, may be strengthened, on the order of 35% or more, in accordance with the teachings of the invention and still possess adequate ductility to be formed. As noted above, titanium, tin, manganese, various aluminum alloys, various copper alloys and various nickel alloys are other materials that nndergo such allotropic transformations. Titanium alloys, though quite expensive, find wide use in many applications, particularly in aircraft skin where high strength and weight reduction are key design goals. Through applicant's teachings disclosed herein, these materials can be hardened while still retaining ductility. For example, a given thickness of titanium sheet (strip) can be forced to transform in a region beginning at each of its surfaces and extending therebelow to a pre-set depth to yield a ductile equiaxed grain structure in these regions while the core retains a hardened deformed cold worked structure. Such a sheet will be stronger than a fully annealed sheet and yet be nearly as ductile. To obtain the same strength as the strengthened sheet, the fully annealed sheet would need to be made thicker than the strengthened sheet. This, in turn, consumes more material and raises the cost of the final sheet. However, by using a sheet of titanium that has been strengthened in the inventive manner set forth herein, thinner sheet stock can be used with concomitant savings in material cost and weight over that which could be employed heretofore. Inasmuch as titanium alloys are extremely expensive and extensive quantities are often used in a single application, such as in fabricating an aircraft, the resulting cost savings in material can be quite significant in an application. Moreover, ordinary low carbon steel that has been strengthened, typically by as much as 35%, as described herein, may displace other higher cost steel alloys. Alternatively, thinner strengthened steel stock can be used in many applications, such as in automobile and appliance body parts thereby advantageously providing a significant weight reduction and material savings, over the use of a thicker sheet of fully annealed low carbon steel.

Applicant's inventive strengthened materials offer several distinct and major advantages over conventional commercially available alloys that offer high strength and modest formability.

The first major advantage is cost. Conventionally produced alloys that would offer the same strength and ductility, as a strengthened material produced in accordance with the invention, are widely available but are more expensive than the strengthened material. This occurs for several reasons. First, conventionally produced alloys that offer high strength and good formability require exotic and expensive alloying elements, such as columbium and vanadium. However, the inventive strengthened materials would advantageously require a reduced amount of each alloying element or even none at all to provide the same strength and formability as conventionally produced alloys. Second, these conventionally produced alloys need to undergo complex/-thermal processing to provide increased strength and good formability. Specifically, conventionally produced alloys undergo heat treatments upon exiting the cold mill. This, in turn, requires equipment that performs continuous or batch annealing. Annealing furnaces and associated ancillary equipment, such as tracks, cars, tractors, cranes and atmosphere preparation equipment, are quite expensive, while continuous annealing equipment is even more expensive. Furthermore, for conventional annealing to produce fully equiaxed grains, in a very short time, which impart ductility to the final structure, the annealing would need to occur above the Ae3 temperature. At these temperatures, significant amounts of scale develops on all surfaces of the strip unless the annealing is performed in a protective atmosphere. Equipment designed to remove large amounts of scale is expensive and generally utilizes dangerous and corrosive reagents, which are costly to obtain and dispose. Alternatively, annealing in a protective atmosphere requires large amounts of suitable gases, such as nitrogen or cracked ammonia with the latter being expensive to obtain. As such, annealing equipment carries high initial costs and significant operating costs which, in turn, significantly adds to the cost of any resulting strip that will be produced using the equipment. The inventive strengthened materials advantageously incur none of these costs. Inasmuch as applicant's inventive materials undergo transformation at relatively low temperatures, i.e. several hundred degrees C, any surface scale that would form on these materials would likely be minimal, as noted above, and can be removed by a simple and inexpensive light pickling operation or prevented by using a shielding gas. If no surface scaling occurs, then no pickling operation is necessary thereby resulting in additional process cost savings. Furthermore, conventionally produced metals are often cold rolled, after they have been annealed, to increase their hardness. By eliminating the need for conventional annealing, applicant's strengthened materials do not need to be run through cold rolling mills specifically for the purpose of strengthening. This, in turn, eliminates the need for one or more rolling steps, and associated labor and rolling stands, that typically occur in the production of conventionally annealed metals. Consequently, this generates further cost savings over conventionally produced metals.

In addition, plain carbon steels are much easier to resistance weld and form than HSLA or alloy steels. Therefore, by using a plain carbon steel alloy that has been strengthened in the manner set forth above in lieu of a conventionally produced HSLA or alloy steels which offer similar values of strength and ductility, simple and relatively inexpensive welding procedures can be used thereby resulting in further cost savings.

As a result of these cost savings, the use of applicant's inventive strengthened materials may well advantageously displace the use of higher cost alloys that provide equal amounts of strength and ductility. Specifically, a low cost ductile low carbon steel alloy which would otherwise not offer adequate strength can be strengthened, in the inventive manner set forth above, and still retain its ductility. Hence, where in the past a high strength steel alloy produced using conventional heat treatment might be required, an inventive low carbon steel alloy, which would be formed from a lower strength plain carbon steel that has been strengthened by a cold worked core and contains equiaxed surface regions for good workability, could be used instead. The inventive process is not limited to low carbon steels but is also applicable to alloyed materials. For example, a low alloy material could be strengthened, in the inventive manner, to provide a material having a yield strength and ductility comparable to those of a conventionally produced higher alloy material, thereby advantageously reducing both the amount of alloying elements needed to produce the strengthened material and hence the cost of this material.

The second major advantage inherent in applicant's strengthened materials over conventionally produced alloys that provide high strength and good formability is the reduction of directional properties and, as noted above, improved corrosion resistance. Conventionally produced materials are hardened through cold working occurring subsequent to annealing. The resultant structure contains deformed grains on its surfaces which exhibit directional bending properties. Hence, surface cracking will often first appear in a cold rolled material in response to transversely oriented stresses. These cracks will then propagate inward and eventually cause an entire cross-section of the material to fail. In contrast, equiaxed grains present in the surfaces of applicant's inventive materials have relatively low internal energy and are quite ductile in any direction. Therefore, applicant's inventive materials are substantially less directional and hence much less susceptible to surface cracking and corrosion than conventionally produced alloys.

Those skilled in the art clearly recognize that the rolls shown in FIGS. 4 and 5 may be in any one of several different well known configurations. Moreover, there may be more than one rolling stand which successively produces these transformations in the strip. In this case, each rolling stand would induce a transformation to occur as a result of high speed deformation imparted to the strip. Each successive transformation would produce successive grain refinement, i.e. increasingly finer grains in those areas that have experienced successive total or partial transformations. Inasmuch as localized transformations occur at each of these rolling stands, this advantageously provides the potential of eliminating the need for separate heat treatments between the separate rolling passes. Now, whether the strip can undergo just one or more successive rolling passes to produce successive localized transformations in the strip will be governed, at least in part, by the desired reduction that is to be provided by each pass and the final desired thickness of the strip.

Figure 14:
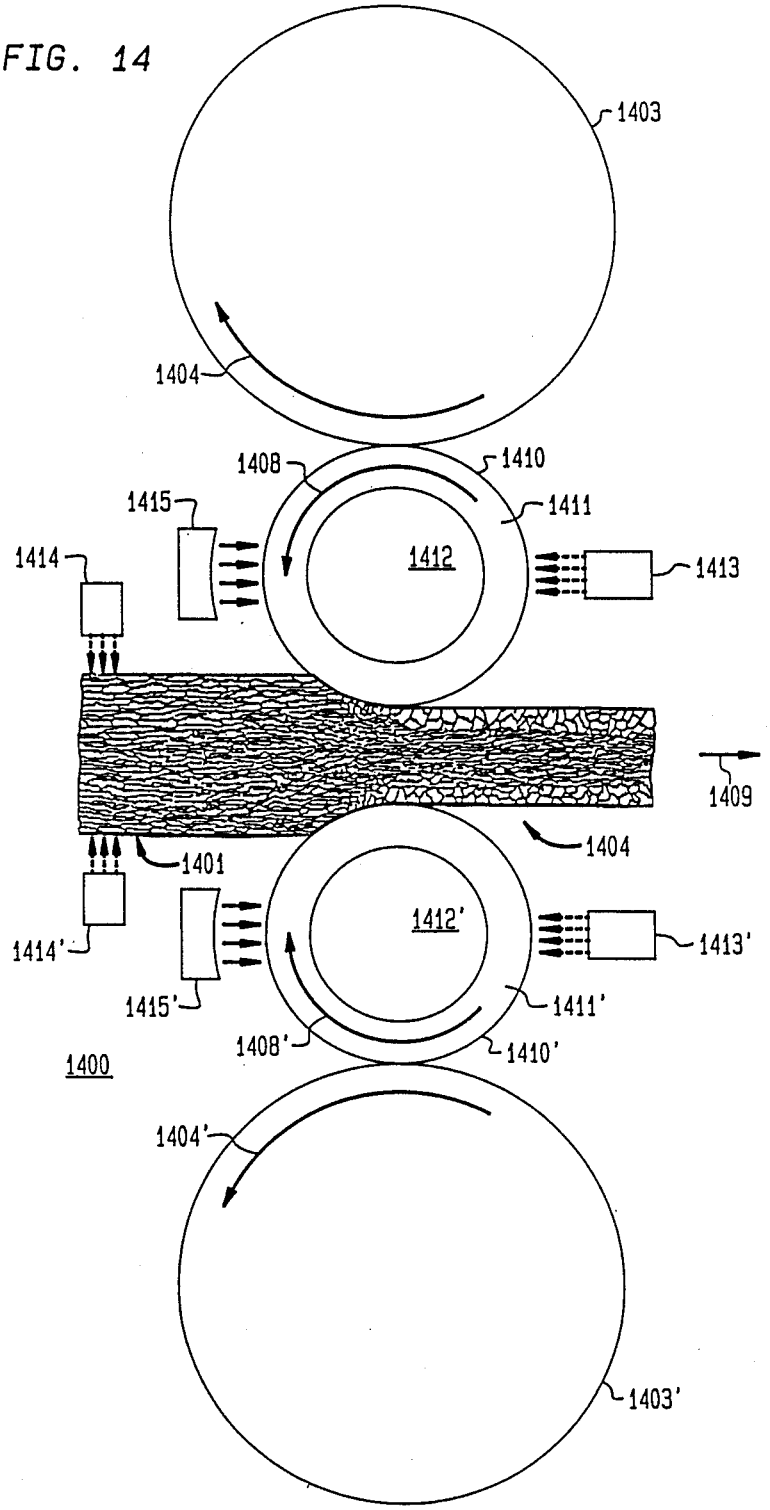
FIG. 14 shows a simplified side elevational view of another embodiment of applicant's inventive apparatus, specifically a single four high roll stand that uses two work rolls and two backup rolls.

In particular, FIG. 14 shows a simplified side elevational view of another embodiment of applicant's inventive apparatus, specifically a single four high roll stand 1400 that uses two work rolls 1410 and 1410' and two backup rolls 1403 and 1403'. The work rolls are in contact with input strip 1401 as it enters the rolls. Rolled material 1404 as it exits from the roll gap between the work rolls travels in a direction given by arrow 1409. Work rolls 1410 and 1410' rotate in the directions given by arrows 1408 and 1408', respectively; while backup rolls 1403 and 1403' rotate in the directions given by arrows 1404 and 1404', respectively. Since the work rolls have a relatively small diameter, less force is necessary to roll input strip 1401 than would be required if these rolls had a larger diameter. The work rolls may typically be 5 to 10 inches (approximately 12.7–25.4 centimeters) in diameter, while the backup rolls may typically be between 10 to 40 inches (approximately 25.4–101.6 centimeters) in diameter. Moreover, the support bearings (well known and not shown) for all these rolls must withstand substantial forces. The inventive method, as discussed above, uses work rolls that must operate at an elevated temperature. In order for the work roll support bearings to operate at low temperatures, the work roll shaft ends and all work roll support bearings may need to be cooled. Alternatively, the need for such cooling can be reduced, if not eliminated, if the material on the surface of the work rolls has a very low thermal conductivity. Use of such a material would advantageously permit the surface of each work surface to rise to a moderate temperature while the core and shaft ends of the roll remained at or near room temperature. Accordingly, the surface of each work roll may be formed of a relatively thick coating of a suitable ceramic or high temperature material. For example, as shown, work rolls 1410 and 1410, may have a coating 1411 and 1411' of a suitable material, such as silicon carbide, bonded to axles (or cores) 1412 and 1412', respectively. Because such a ceramic material has a poor thermal conductivity and a low specific heat, the roll surface can be brought up in temperature with very little applied heat. Moreover, the poor thermal conductivity of this material limits the amount of heat that would otherwise flow from the surface of the rolls to axles 1412 and 1412' and hence reduces, if not eliminates, any need to cool the work roll support bearings. Furthermore, in the case of a Sendzimir mill where the work rolls may be confined by several rolls, work roll support bearings may not be necessary. Clearly, a roll coated with a ceramic or high temperature material provides less available heat than a roll made entirely from metals such as cast iron or steel.

As such, in addition to a reduced heat flow to work roll axles 1412 and 1412', use of ceramic or high temperature coating 1412 and 1412' on the work rolls causes the amount of heat that would be transferred by the work rolls to back up rolls 1403 and 1403' to also be quite small.

The temperature of the surface of each work roll is advantageously maintained at a desired temperature while the roll is in contact with material 1401. Work rolls 1412 and 1412' are cooled on their exit side by spray coolers 1413 and 1413', respectively, that both spray water or a suitable mixture of water and oil onto these rolls. Rolls 1412 and 1412' are also heated, during startup and at any time when necessary throughout a rolling operation, by suitable heaters 1415 and 1415', respectively, that are positioned on the input (entry) side of these rolls. These heaters can be radiant heaters. Input strip 1401 is cooled by spray coolers 1414 and 1414' to insure that the temperature of the strip is at or near room temperature as it enters the roll gap. The amount of heat generated in strip 1401 from previous cold rolling must be removed before the strip is enters rolls 1410 and 1410'. In the event that this strip was cold rolled at some previous time and had a sufficient time to cool to or near room temperature, then no cooling of the strip would be necessary. This cooling and heating procedure is different from that normally encountered in cold rolling inasmuch as the input side of the work rolls may need to be heated to a desired temperature.

Back up rolls 1403 and 1403' may be fabricated from cast iron or a suitable steel typically used in back up roll service. The axle for work rolls 1410 and 1410' is advantageously a suitable steel, preferably a high strength alloy steel. Inasmuch as some bending of the work rolls will occur in the rolling operation, the core material used in the work rolls must be able to withstand continuous and intermittent side loading which may be present in the rolling operation. If the work rolls are expected to encounter heavy side loads, then additional side support rolls may be necessary. The material used in the surface of the work rolls must be very hard, be able to withstand large compressive loads, be suitable for surface finishing for providing satisfactory rolled surfaces on the strip being processed and remain stable at elevated temperatures which will be encountered in the inventive process. The highest temperature that the work rolls must endure may be approximately 500 degrees C. Since ceramics (or other suitable high temperature materials) which remain stable to approximately 1200 degrees C. are readily available, an axle with a concentrically and coaxially oriented cover made of such a ceramic (or other suitable high temperature material) specifically developed for use as a work roll may be advantageously used. Alternatively, each work roll may be fabricated with a steel axle that has been covered, in a concentric and coaxial fashion, by a suitable thermal insulator, which may be a ceramic, followed by a concentric and coaxially oriented tubular cover (such as a heavy wall tubing) which protects the thermal insulator. Inasmuch as suitable ceramics (or high temperature materials) are currently available, the tubular cover can advantageously be fabricated from a ceramic (or high temperature material) in lieu of a metal.

A material with the equiaxed surface structure and banded core produced in accordance with the teachings of the invention would have directional mechanical properties in only the core material. The remaining directionality due to the core material can be substantially reduced or essentially eliminated by using a cross rolling process. Here, the strip is generally sheared to an appropriate length prior to being inserted in a cross rolling mill, thereby obviating the need to use a continuous cross rolling mill which is very expensive.

Moreover, as noted above, other processes than rolling can be used to generate high speed deformations. These processes illustratively include forging and extruding (wire drawing). Hence, material with surfaces of equiaxed grains and a core of elongated grains can be readily formed as sheet (strip) using rolling, wire using extruding, or in other shapes, particularly thin sections, using high speed forging, including but not limited to explosive forging. If extrusion is used, then the extrusion die must be allowed to rise in temperature and preferably no or minimal lubricant must be used. Clearly the rate at which the material is forced through the die and the amount of resulting reduction are suitably adjusted to provide a desired amount of deformation and a resulting high heating rate in the deformed material. If lubricant is to be used, then only enough is used to prevent any material from sticking to the die, but not enough is used to cool the die. The die may also be maintained at a temperature slightly in excess of the final desired end temperature of the material in order to prevent the die from cooling the material by conduction. By eliminating these conductive heating losses, as mentioned above in conjunction with rolling, the heating rate of the material is effectively increased which further depresses the transformation temperatures.

Figure 11:
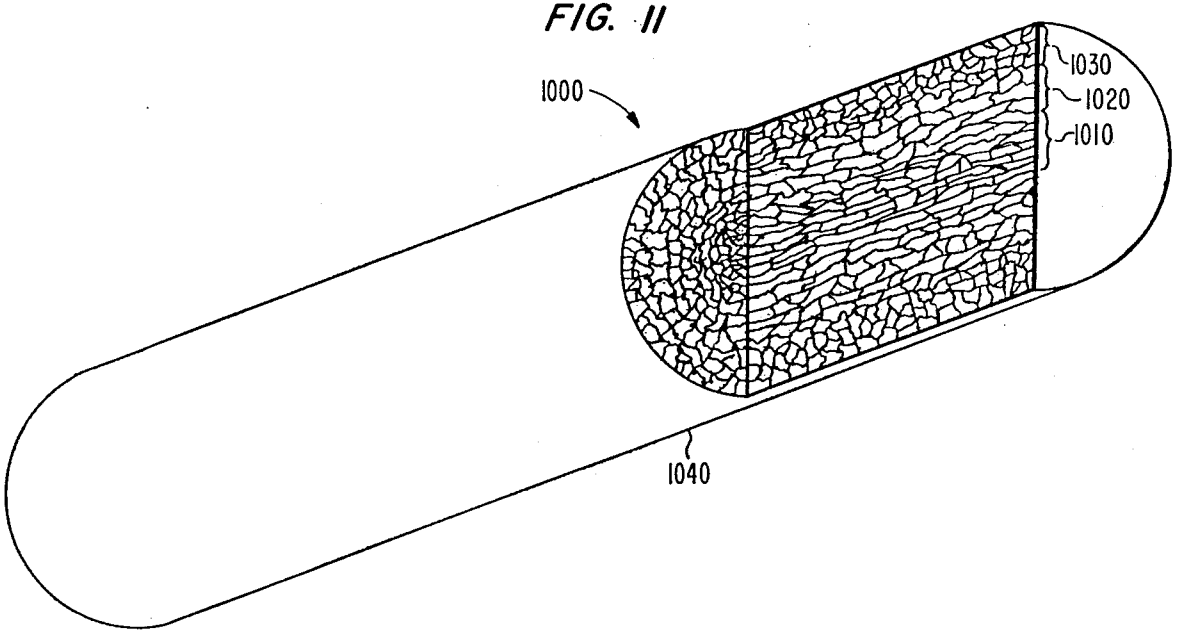
FIG. 11 shows a perspective cut away cross-sectional view of an embodiment of applicant's inventive material in wire form;.

A perspective cut away cross-sectional view of one embodiment of the resulting wire, fabricated in accordance with the teachings of the present invention, would typically resemble that shown in FIG. 11. Here, wire 1100 consists of core 1110 containing deformed elongated grains, which provide high strength, coaxially aligned with two-phase region 1120 and surface region 1130. The surface region extends radially inward from surface 1140 and consists of transformed equiaxed grains that impart ductility to the wire. Although, this wire is shown as having a circular cross-section, the wire could easily be fabricated with other cross-sectional shapes, e.g. square, rectangular, oval or triangular, by merely changing the shape of the die.

Although various embodiments of the inventive apparatus and various accompanying inventive methods have been shown and described herein for producing applicant's inventive materials, those skilled in the art clearly realize by now that many other varied embodiments of the apparatus and other accompanying methods can be constructed which nonetheless incorporate the teachings of the present invention.

I claim:

1. A method for producing a material from a base metal, wherein the base metal has a structure capable of undergoing an allotropic transformation and possesses continuous heating upper and lower transformation temperatures that depress whenever a suitable amount of energy at a sufficient rate of change thereof is imparted to the base metal, said method comprising the steps of:

maintaining a piece of base metal at a relatively low temperature prior to its deformation;

maintaining a tool at a desired temperature elevated from that of said base metal piece; and rapidly deforming the base metal piece by a predefined amount with said tool in order to impart a suitable amount of energy at a substantial rate of change into said base metal to depress the upper and lower transformation temperatures so as to cause at least a pre-defined surface region of said piece to reach a temperature in excess of the depressed upper transformation temperature such that the base metal structure situated in said region transforms into substantially equiaxed grains.

2. The method of claim 1 wherein said deforming step comprises the step of rapidly applying a pre-defined amount of deformation to said piece such that said region extends into said piece from a surface thereof to approximately a pre-defined depth therein.

3. The method of claim 2 further comprising the step of utilizing a metal that has a substantially equiaxed structure, a relatively high internal energy or a substantially deformed crystalline structure as said base metal.

4. The method of claim 3 wherein said rapid deforming step comprises the step of deforming said piece by rolling, extruding or forging.

5. The method of claim 4 wherein the tool temperature maintaining step further comprises the step of cooling the surface of said tool to the desired temperature after the deformation has occurred.

6. The method of claim 5 wherein said rapid deforming step comprises the step of routing said piece between two work rolls of at least a two high rolling mill, wherein the work rolls are spaced apart by a pre-determined amount in order to impart a pre-defined amount of deformation to said piece.

7. The method of claim 6 further comprising the step of setting an appropriate rotational speed of each of the work rolls to a value such that, during said deformation: (a) the base metal structure situated within said surface region of said piece reaches a temperature greater than the depressed upper transformation temperature and the base metal structure situated within a core of said piece reaches a temperature less than the lower depressed transformation temperature whereby relatively ductile equiaxed grains are produced in said surface portion and elongated grains having a relatively high strength remain in the core of said piece, or (b) the base metal structure situated substantially throughout said piece reaches a temperature greater than the depressed upper transformation temperature whereby relatively ductile equiaxed grains are produced substantially throughout said piece.

8. The method in claim 7 wherein said deforming step comprises the step of either applying lubricant to said tool in an amount less than or equal to that which is minimally required to prevent the piece from sticking to the tool during deformation or alternatively applying no lubricant to said tool.

9. The method of claim 8 wherein the base metal temperature maintaining step comprises the step of maintaining said piece at a temperature that is substantially below the lower depressed transformation temperature.

10. The method of claim 8 further comprising the steps of:

applying heat to an entry side of a surface of each of said work rolls prior to the occurrence of said deformation so as to raise the temperature of the work roll surfaces to said desired temperature;

routing said piece between said heated work rolls in order to impart said deformation to said piece;

cooling an exit side of the surfaces of said work rolls after said deformation has occurred in order to remove excess heat therefrom.

11. The method of claim 8 further comprising the step of employing a relatively small diameter roll for each of said work rolls so as to produce an increased rate of deformation of said piece, thereby increasing the bulk heating of the piece.

12. The method of claim 8 further comprising the step of employing a relatively large diameter roll for each of said work rolls so as to increase sliding friction occurring between the piece and each of the work rolls, thereby increasing the surface heating of the piece.

13. The method of claim 8 wherein the rapid deforming step further comprises the step of using at least one work roll having a pre-defined surface texture so as to increase the amount of sliding friction occurring between the one work roll and the piece.

14. The method of claim 8 wherein the deforming step further comprises the step of employing a work roll having a surface fabricated from either a ceramic or a material that has a poor thermal conductivity.

15. The method of claim 8 further comprising the step of maintaining the piece, as it exits from the work rolls, in a suitable non-oxidizing atmosphere until each surface of the piece cools to a temperature less than that at which detrimental scaling or surface discoloration due to oxidation would ordinarily occur.

16. The method of claim 8 further comprising the step of establishing a rate at which said piece will be deformed to yield a bulk heating rate in said region in excess of 10,000 degrees C./second.

17. The method of claim 8 further comprising the step of successively repeating the deformation step at least once so as to refine grains existing in said region that have experienced either full or partial transformation.

18. The method in claim 8 further comprising the step of employing two back-up rolls for preventing both of said work rolls from deflecting while said deformation is occurring, wherein each of the back-up rolls is located in abutting rotational contact with a corresponding one of the work rolls such that each of the back-up rolls abuts against a side, of the corresponding work roll, that is oppositely situated from a roll gap formed between both of said work rolls.

19. The method of claim 18 further comprising the step of employing a relatively small diameter roll for each of said work rolls so as to produce an increased rate of deformation of said piece, thereby increasing the bulk heating of the piece.

20. The method of claim 19 wherein the deforming step further comprises the step of employing a work roll having a surface fabricated from either a ceramic or a material that has a poor thermal conductivity.

21. The method of claim 20 further comprising the step of utilizing for each of said work rolls, a roll of appropriate diameter comprising a metallic shaft concentrically surrounded by a thermal insulating layer which, in turn, is concentrically surrounded by a suitable material for providing a desired rolling surface.

22. A method for producing a material from a base metal, wherein the base metal has a structure capable of undergoing an allotropic transformation and possesses continuous heating upper and lower transformation temperatures that depress whenever a suitable amount of energy at a sufficient rate of change thereof is imparted to the base metal, said method comprising the steps of:

maintaining a piece of base metal at a relatively low temperature prior to its deformation;

maintaining a tool at a desired temperature elevated from that of said base metal piece; and rapidly deforming the base metal piece by a pre-defined amount with said tool in order to impart a suitable amount of energy at a substantial rate of change into said base metal to depress the upper and lower transformation temperatures so as to cause at least a pre-defined surface region of said piece to reach a temperature in excess of the depressed lower transformation such that at least some of the base metal structure situated in said region partially transforms.

23. The method of claim 22 wherein said deforming step comprises the step of rapidly applying a pre-defined amount of deformation to said piece such that said region extends into said piece from a surface thereof to approximately a pre-defined depth therein.

24. The method of claim 23 further comprising the step of utilizing a metal that has a substantially equiaxed structure, a relatively high internal energy or a substantially deformed crystalline structure as said base metal.

25. The method of claim 24 wherein said rapid deforming step comprises the step of deforming said piece by rolling, extruding or forging.

26. The method of claim 25 wherein the tool temperature maintaining step further comprises the step of cooling the surface of said tool to the desired temperature after the deformation has occurred.

27. The method of claim 26 wherein the base metal temperature maintaining step comprises the step of maintaining said piece at a temperature that is substantially below the lower depressed transformation temperature.

28. The method of claim 26 wherein said rapid deforming step comprises the step of routing said piece between two work rolls of at least a two high rolling mill, wherein the work rolls are spaced apart by a pre-determined amount in order to impart a pre-defined amount of deformation to said piece.

29. The method of claim 28 further comprising the steps of:

applying heat to an entry side of a surface of each of said work rolls prior to the occurrence of said deformation so as to raise the temperature of the work roll surfaces to said desired temperature;

routing said piece between said heated work rolls in order to impart said deformation to said piece;

cooling an exit side of the surfaces of said work rolls after said deformation has occurred in order to remove excess heat therefrom.

30. Apparatus for producing a material from a base metal, wherein the base metal has a structure capable of undergoing an allotropic transformation and possesses continuous heating upper and lower transformation temperatures that depress whenever a suitable amount of energy at a sufficient rate of change thereof is imparted to the base metal, said apparatus comprising:

means for maintaining a piece of base metal at a relatively low temperature prior to its deformation;

means for maintaining a tool at a desired temperature elevated from that of said base metal piece; and means for rapidly deforming the base metal piece by a pre-defined amount with said tool in order to impart a suitable amount of energy at a substantial rate of change into said base metal to depress the upper and lower transformation temperatures so as to cause at least a pre-defined surface region of said piece to reach a temperature in excess of the depressed upper transformation temperature such that the base metal structure situated in said region transforms into substantially equiaxed grains.

31. The apparatus of claim 30 wherein said rapid deforming means comprises means for deforming said piece by rolling, extruding or forging.

32. The apparatus of claim 31 wherein said rapid deforming means comprises two work rolls of at least a two high rolling mill, wherein the work rolls are spaced apart by a pre-determined amount in order to impart a pre-defined amount of deformation to said piece.

33. The apparatus of claim 32 wherein the base metal temperature maintaining means maintains the temperature of said piece at a value that is substantially below the lower depressed transformation temperature.

34. The apparatus of claim 32 further comprising means for cooling an exit side of the surfaces of said work rolls to said desired temperature after said deformation has occurred.

35. The apparatus of claim 32 wherein each of said work rolls is a relatively small diameter roll so as to increase rate of deformation of said piece, thereby increasing the bulk heating of the base metal.

36. The apparatus of claim 32 wherein each of said work rolls is a relatively large diameter roll so as to increase sliding friction occurring between the piece and each of the work rolls, thereby increasing the surface heating of the piece.

37. The apparatus of claim 32 wherein the rapid deforming means further comprises at least one work roll having a pre-defined surface texture so as to increase the amount of sliding friction occurring between the one work roll and the piece.

38. The apparatus of claim 32 wherein the deforming step means further comprises a work roll having a surface fabricated from either a ceramic or a material that has a poor thermal conductivity.

39. The apparatus of claim 32 further comprising means for maintaining the piece, as it exits from the work rolls, in a suitable non-oxidizing atmosphere until each surface of the piece cools to a temperature less than that at which detrimental scaling or surface discoloration due to oxidation would ordinarily occur.

* * * * *